US009163500B2

(12) United States Patent
Tao et al.

(10) Patent No.: US 9,163,500 B2
(45) Date of Patent: Oct. 20, 2015

(54) EXTENDABLE AND ELONGATING MECHANISM FOR CENTRALIZING A DOWNHOLE TOOL WITHIN A SUBTERRANEAN WELLBORE

(75) Inventors: Chen Tao, Sugar Land, TX (US); Thomas W. Meyer, Manvel, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 653 days.

(21) Appl. No.: 13/248,845

(22) Filed: Sep. 29, 2011

(65) Prior Publication Data

US 2013/0081803 A1 Apr. 4, 2013

(51) Int. Cl.
*E21B 49/10* (2006.01)
*E21B 17/10* (2006.01)

(52) U.S. Cl.
CPC ..... *E21B 49/10* (2013.01); *E21B 17/1014* (2013.01)

(58) Field of Classification Search
CPC ..... E21B 47/00; E21B 17/1014; E21B 33/13; E21B 49/10
USPC ..... 166/100, 118, 206, 250.01, 250.11; 324/367
See application file for complete search history.

(56) References Cited

U.S. PATENT DOCUMENTS 3,209,588 A * 10/1965 Terry ..... 73/152.12
3,423,671 A * 1/1969 Vezin ..... 324/347
4,994,671 A 2/1991 Safinya et al.
5,166,747 A 11/1992 Schroeder et al.
5,433,276 A 7/1995 Martain et al.
5,939,717 A 8/1999 Mullins
5,956,132 A 9/1999 Donzier
6,092,416 A 7/2000 Halford et al.
6,174,001 B1 1/2001 Enderle
6,641,434 B2 11/2003 Boyle et al.
7,114,562 B2 10/2006 Fisseler et al.
7,243,536 B2 7/2007 Volze et al.
7,726,396 B2 6/2010 Briquet et al.
2005/0284629 A1 * 12/2005 Reid et al. ..... 166/264
2010/0264915 A1 10/2010 Saldungaray et al.

OTHER PUBLICATIONS

Lebourg, M., Fields, R. Q., & Doh, C. A. (Jan. 1, 1957). A Method of Formation Testing on Logging Cable. Society of Petroleum Engineers.*

* cited by examiner

*Primary Examiner* — David Andrews
*Assistant Examiner* — Kristyn Hall
(74) *Attorney, Agent, or Firm* — Cathy Hewitt; Kenneth Kincaid

(57) ABSTRACT

An apparatus including a downhole tool for conveyance in a wellbore extending into a subterranean formation. The downhole tool includes a feature to physically interface a sidewall of the wellbore, and first and second setting pistons each extendable from the downhole tool opposite the feature. The downhole tool also includes a rigid member spanning and extendable with the first and second setting pistons, wherein a length of the rigid member is variable.

21 Claims, 20 Drawing Sheets

EXTENDABLE AND ELONGATING MECHANISM FOR CENTRALIZING A DOWNHOLE TOOL WITHIN A SUBTERRANEAN WELLBORE

BACKGROUND OF THE DISCLOSURE

Some downhole tools (e.g., well logging tools) include one or more devices that measure various properties of the subterranean formations and/or perform certain mechanical acts on the formation. To accomplish the aforementioned operations, a seal may be created between a probe of the well logging tool and the sidewall of a wellbore. The inability, however, to centralize the well logging tool in the wellbore may result in an incomplete seal between a packer and the sidewall of the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
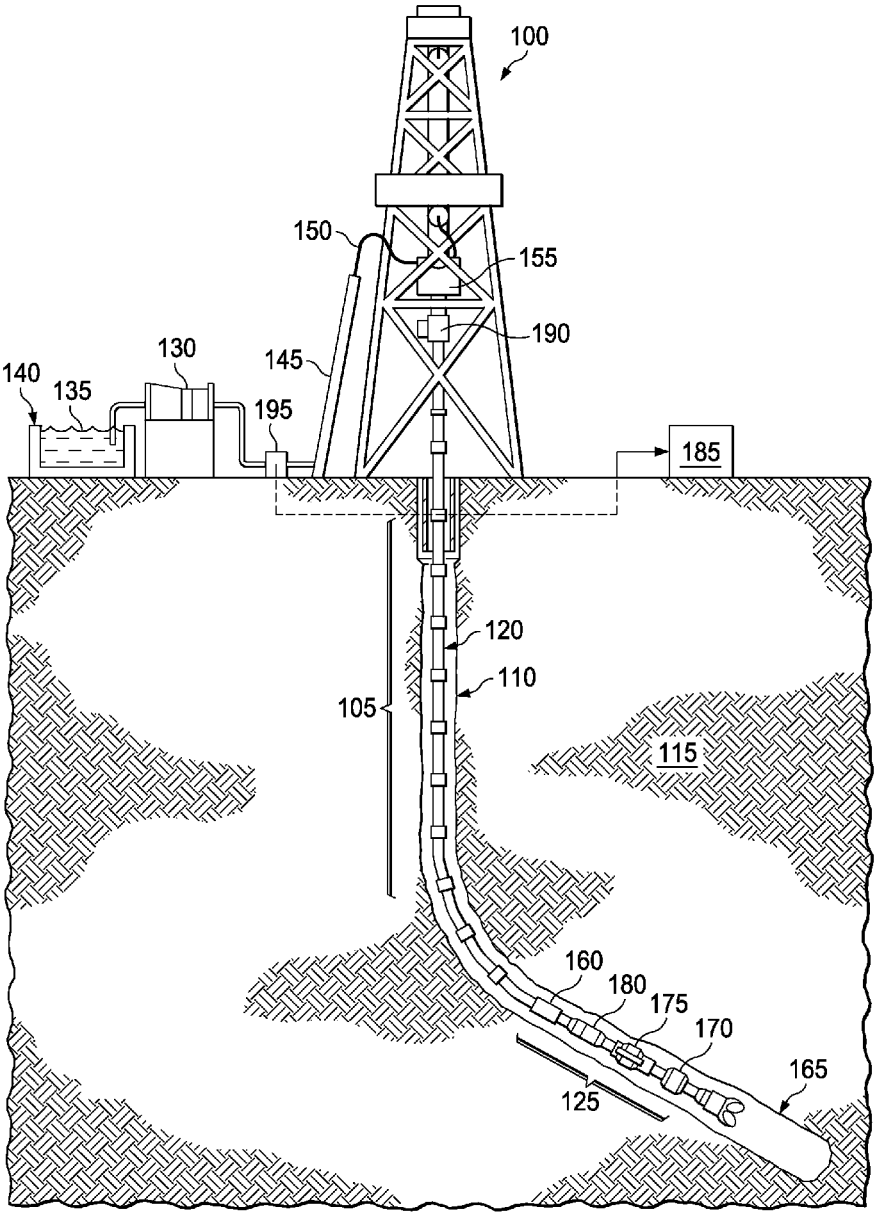
FIGS. 1 to 21 are schematic views of apparatus or portions thereof according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Well logging tools are devices to move through a wellbore drilled through subterranean formations. The well logging tools include one or more devices that measure various properties of the subterranean formations and/or perform certain mechanical acts on the formations, such as drilling or percussively obtaining samples of the subterranean formations, and withdrawing samples of connate fluid from the subterranean formations. Measurements of the properties of the subterranean formations may be recorded with respect to a tool axial position (e.g., depth) within the wellbore as the tool is moved along the wellbore. Such recording is referred to as a well log as performed by well logging tools (or tools in general).

Well logging tools (or tools in general) can be conveyed along the wellbore by extending and withdrawing an armored electrical cable ("wireline"), wherein the well logging tools are coupled to the end of the wireline. Extending and withdrawing the wireline may be performed using a winch or similar spooling device. However, such conveyance relies on gravity to move the well logging tools into the wellbore, which are used on substantially vertical wellbores. Wellbores deviating from vertical may employ additional force for conveyance through the wellbore. For examples of conveyance techniques, see, e.g., U.S. Pat. No. 5,433,276, issued to Martain, et al., entitled "Method and System for Inserting Logging Tools into Highly Inclined or Horizontal Boreholes," issued Jul. 18, 1995, and U.S. Pat. No. 6,092,416, issued to Halford, et al., entitled "Downhole System and Method for Determining Formation Properties," issued Jul. 25, 2000, which are incorporated herein by reference in their entirety. Various other tools also exist for testing and logging while drilling such as a formation pressure while drilling tool.

To operate and perform tasks such as measuring local environmental parameters and sampling formation fluids, a downhole/wireline tool for conveyance in a wellbore may be provided with pressure measurement and sampling capabilities, and may also have pump-out capabilities. A downhole tool measures pressures and take high quality samples at high temperatures and pressures, such as 375 degrees Fahrenheit ("F") and 20,000 pounds per square inch ("psi"). The downhole tool may employ a focused sampling technique that uses two flowlines and two probe packers. An inner packer is used with a probe to collect a clean sample from a surrounding subterranean structure, and an outer packer is used to pump mud filtrate away from the inner packer and the probe.

Wireline formation testing tools or services employed in the wellboring industry include, without limitation, a modular formation dynamics tester ("MDT"), a repeat formation tester ("RFT"), and a slimhole repeat formation tester ("SRFT"), a reservoir pressure while logging service ("PressureXpress")). Sampling of surrounding wellbore structures can be performed with the aid of pumps such as the modular formation dynamics tester with a pump-out unit, and without pumps such as the repeat formation tester. In accordance therewith, a complete seal may be created between a packer and the sidewall of the wellbore to avoid contaminating the samples.

As mentioned above, some existing tools are equipped with probes and/or dual packers. Again, the inability to centralize a tool in the wellbore may result in an incomplete seal between a packer and the sidewall of the wellbore, resulting in substantial leakage therebetween, and inaccurate measurements such as pressure measurements. A downhole tool may be centralized in a wellbore so, for instance, a complete seal can be created between a packer and the sidewall of the wellbore.

The apparatus and methods of the present disclosure will be described with respect to embodiments in a specific context, namely, a feature of a downhole tool to interface a sidewall of a wellbore with a rigid member spanning first and second setting pistons of the downhole tool opposite the feature to centralize the downhole tool in the wellbore. While one or more aspects of the present disclosure may be described in the environment of a wellbore, any downhole application that may employ a centralizing mechanism as described herein is well within the broad scope of the present disclosure.

The rigid member spanning first and second setting pistons may be employed in the environment of a system and method for centralizing a module of downhole tool in a wellbore, or a "string" of such downhole tools in a wellbore (also referred to as a borehole) using a wired drill pipe for conveyance and signal communication. The wired drill pipe string may be assembled and disassembled in segments to effect conveyance of segmented drill pipes through a wellbore. While the rigid member spanning first and second setting pistons is described as used with tools commonly conveyed on a wireline ("wireline tools"), the rigid member spanning first and second setting pistons may be implemented with any other type of downhole tool such as logging while drilling ("LWD") tools.

Referring initially to FIG. 1, illustrated is a schematic view of an apparatus or portions thereof according to one or more aspects of the present disclosure. The apparatus includes a drilling rig 100 or similar lifting device employable to move a wired drill pipe string 105 within a wellbore 110 that has been drilled through subterranean formations, shown generally at 115, that provides an environment for application of one or more aspects of the present disclosure. The wired drill pipe string 105 may be extended into the wellbore 110 by threadedly coupling together end to end a number of coupled drill pipes (one of which is designated 120) of the wired drill pipe string 105. The wired drill pipe string 105 may be structurally similar to ordinary drill pipes, as illustrated for example, in U.S. Pat. No. 6,174,001, issued to Enderle, entitled "Two-Step, a Low Torque, Wedge Thread for Tubular Connector," issued Aug. 7, 2001, which is incorporated herein by reference in its entirety, and includes a cable associated with each drill pipe 120 that serves as a communication channel. The cable may be any type of cable capable of transmitting data and/or signals, such as an electrically conductive wire, a coaxial cable, an optical fiber or the like.

The wired drill pipe string 105 includes some form of signal coupling to communicate signals between adjacent drill pipes when coupled end to end as illustrated. See, as a non-limiting example, the description of one type of wired drill pipe string having inductive couplers at adjacent drill pipes in U.S. Pat. No. 6,641,434, issued to Boyle, et al., entitled "Wired Pipe Joint with Current-loop Inductive Couplers," issued Nov. 4, 2003, which is incorporated herein by reference in its entirety. However, one or more aspects of the present disclosure are not limited to the wired drill pipe string 105 and can include other communication or telemetry systems, including a combination of telemetry systems, such as a combination of wired drill pipe string, mud pulse telemetry, electronic pulse telemetry, acoustic telemetry, or the like.

The wired drill pipe string 105 may include one, an assembly, or a "string" of downhole tools at a lower end thereof. In the present example, the downhole tool string may include well logging tool(s) 125 coupled to a lower end thereof. As used in the present description, the term "well logging tool," or a string of such tools, refers to, for example, one or more wireline well logging tools that are capable of being conveyed through a wellbore 110 using armored electrical cable ("wireline"), logging while drilling tools, formation evaluation tools, formation sampling tools, and/or other tools capable of measuring a characteristic of the subterranean formation 115 and/or of the wellbore 110. One or more of the well logging tool(s) 125 or downhole tools may employ a centralizing mechanism as described in more detail below.

Several of the components disposed proximate the drilling rig 100 may be used to operate components of the system. These components will be explained with respect to their uses in drilling the wellbore 110 for a better understanding thereof. The wired drill pipe string 105 may be used to turn and axially urge a drill bit into the bottom of the wellbore 110 to increase its length (depth). During drilling of the wellbore 110, a pump 130 lifts drilling fluid ("mud") 135 from a tank 140 or pit and discharges the mud 135 under pressure through a standpipe 145 and flexible conduit 150 or hose, through a topdrive 155 and into an interior passage (not shown separately in FIG. 1) inside the wired drill pipe string 105. The mud 135, which can be water- or oil-based, exits the wired drill pipe string 105 through courses or nozzles (not shown separately) in the drill bit, where it then cools and lubricates the drill bit and lifts drill cuttings generated by the drill bit to the surface of the earth.

When the wellbore 110 has been drilled to a selected depth, the wired drill pipe string 105 may be withdrawn from the wellbore 110. An adapter sub 160 and the well logging tools 125 may then be coupled to the end of the wired drill pipe 105, if not previously installed. The wired drill pipe string 105 may then be reinserted into the wellbore 110 so that the well logging tools 125 may be moved through, for example, a highly inclined portion 165 of the wellbore 110, which would be inaccessible using armored electrical cable ("wireline") to move the well logging tools 125. The well logging tools 125 may be positioned on the wired drill pipe string 105 in other manners, such as by pumping the well logging tools 125 down the wired drill pipe string 105 or otherwise moving the well logging tools 125 down the wired drill pipe 105 while the wired drill pipe string 105 is within the wellbore 110.

During well logging operations, the pump 130 may be operated to provide fluid flow to operate one or more turbines (not shown in FIG. 1) in the well logging tools 125 to provide power to operate certain devices in the well logging tools 125. However, when tripping in or out of the wellbore 110, it may be infeasible to provide fluid flow. As a result, power may be provided to the well logging tools 125 in other ways. For example, batteries may be used to provide power to the well logging tools 125. The batteries may be rechargeable batteries that may be recharged by turbine(s) during fluid flow. The batteries may be positioned within a housing of one or more of the well logging tools 125. Other manners of powering the well logging tools 125 may be used as appreciated by those having ordinary skill in the art.

As the well logging tools 125 are moved along the wellbore 110 by moving the wired drill pipe string 105 as explained above, formation characteristics may be detected by various devices, of which non-limiting examples may include a resistivity measurement device 170, a gamma ray measurement device 175 and a formation fluid sample chamber module 180, which may include a formation fluid pressure measurement device (not shown separately). The signals, which are indicative of the formation characteristics, may be transmitted toward the surface of the earth along the wired drill pipe string 105.

When tripping in and out of the wellbore 110 or performing another process wherein drill pipe 120 is being added, removed or disconnected from the wired drill pipe string 105, an apparatus and system may be employed for communicating from the wired drill pipe string 105 to a surface computer system 185 or other component to receive, analyze, and/or transmit data. Accordingly, a second adapter sub 190 may be coupled between an end of the wired drill pipe string 105 and the topdrive 155 that may be employed to provide a wired or wireless communication channel or path with a receiving unit 195 for signals received from the well logging tools 125. The receiving unit 195 may be coupled to the surface computer system 185 to provide a data path therebetween that may be a bidirectional data path.

Figure 2:
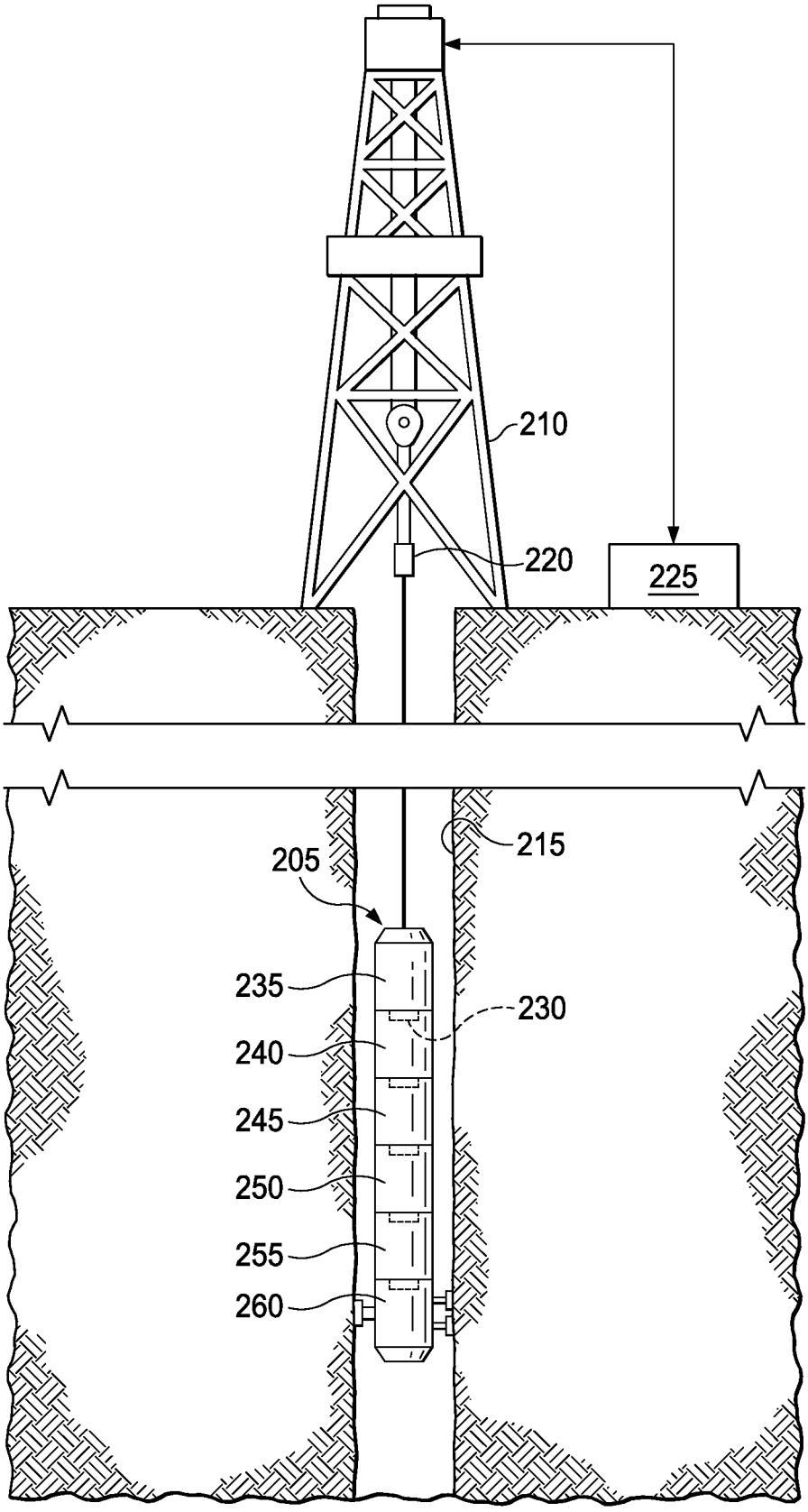

Referring to FIG. 2, illustrated is a schematic view of an apparatus or portions thereof according to one or more aspects of the present disclosure. The apparatus includes a wireline tool 205 deployed from a drilling rig 210 that provides an environment for application of one or more aspects of the present disclosure. The wireline tool 205 may also be directly deployed from a truck without utilizing the drilling rig 210. The wireline tool 205 is suspended in a wellbore 215 from the lower end of a wireline (e.g., multi-conductor cable) 220 that is spooled on a winch supported by the drilling rig 210. At the surface, the wireline 220 is communicatively coupled to a computer system (including a processor, etc.) 225.

The wireline tool 205 may be lowered into the wellbore 215 using the wireline 220. The wellbore 215 traverses a reservoir or subterranean formation. The wireline tool 205 includes several modules connected by field joints (one of which is designated 230). In the illustrated embodiment, the wireline tool 205 includes an electronics module 235, a sample chamber module 240, a first pump-out module 245, a second pump-out module 250, a hydraulic module 255 and a probe module/formation tester (referred to as a probe module) 260. The wireline tool 205 may include any number of modules and may incorporate different types of modules for performing different functions than those described above. The field joints 230 are provided between each adjacent pair of modules for reliably connecting the fluid and/or electrical lines extending through the wireline tool 205.

Figure 3:
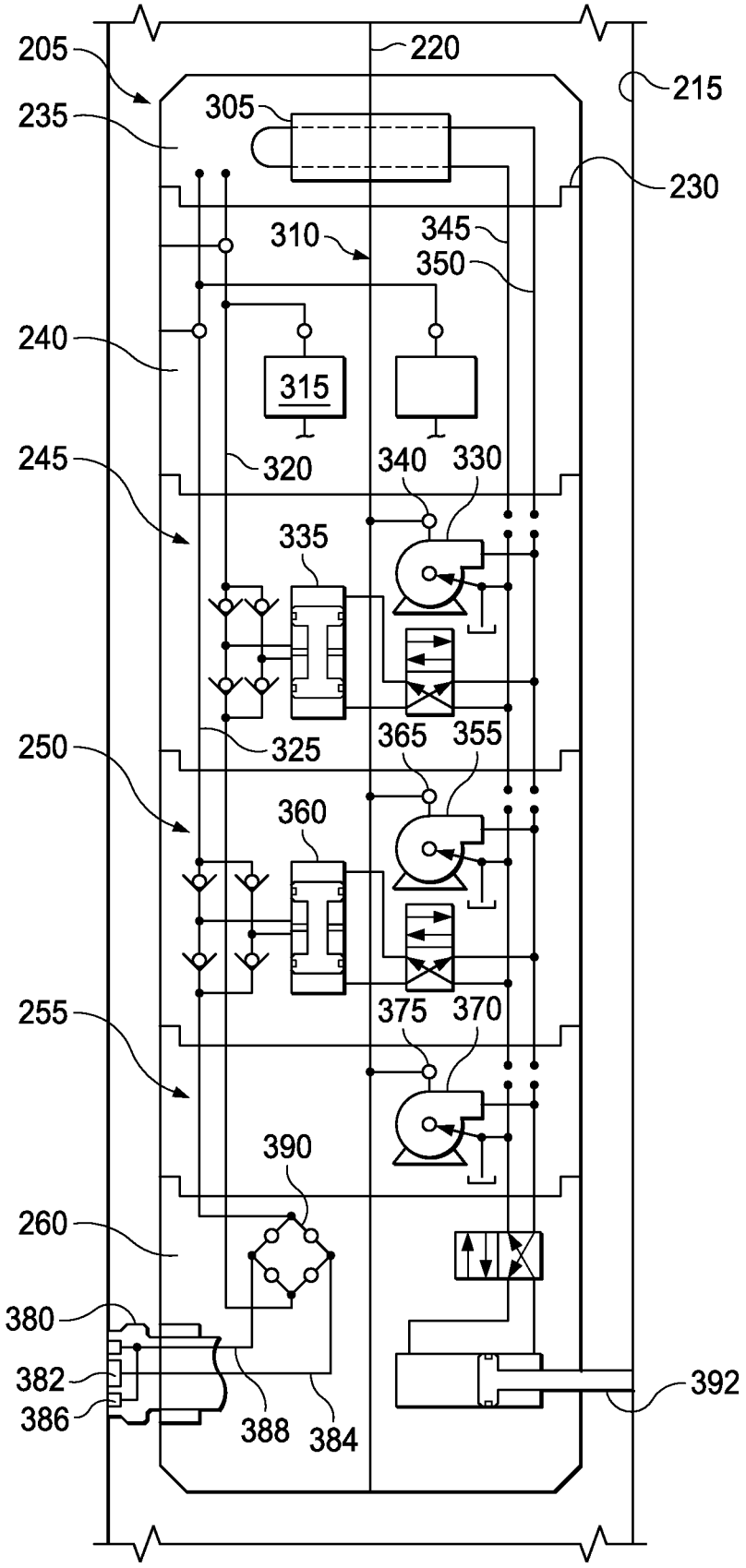

Referring to FIG. 3, illustrated is a schematic view of portions of the wireline tool 205 of FIG. 2 including the electronics module 235, the sample chamber module 240, the first pump-out module 245, the second pump-out module 250, the hydraulic module 255 and the probe module 260 suspendable in the wellbore 215. The electronics module 235 includes an electronics controller 305 operatively coupled to the wireline 220. An electrical line 310 is coupled to an interface of the controller 305 and includes segments that extend through each of the modules. The electrical line 310 transmits electronic signals, which may include the transmission of electrical power and/or data. The sample chamber module 240 includes sample chambers (one of which is designated 315) to store fluid samples.

The first and second pump-out modules 245, 250 control flow through first and second fluid lines 320, 325, respectively. The first pump-out module 245 includes a pump 330 and a displacement unit 335. A motor 340 is operatively coupled to the pump 330. The pump 330 and displacement unit 335 are fluidly coupled to a hydraulic fluid line 345 and a hydraulic fluid return line 350. The displacement unit 335 is also fluidly coupled to the first fluid line 320. The second pump-out module 250 similarly includes a pump 355 and a displacement unit 360, with a motor 365 operatively coupled to the pump 355. The pump 355 and displacement unit 360 are fluidly coupled to the hydraulic fluid line 345 and the hydraulic fluid return line 350. The displacement unit 360 is also fluidly coupled to the second fluid line 325.

The hydraulic module 255 controls the flow of hydraulic fluid through hydraulic fluid lines. The hydraulic module 255 includes a pump 370 fluidly coupled to the hydraulic fluid line 345 and the hydraulic fluid return line 350. A motor 375 is operatively coupled to the pump 370.

The probe module 260 obtains fluid samples from the subterranean formation. The probe module 260 includes a probe assembly (or feature) 380 having a sample inlet 382 fluidly coupled to a sample line 384 and a guard inlet 386 fluidly coupled to a guard line 388. The sample line 384 and guard line 388 are fluidly coupled to a bypass valve system 390, which in turn is fluidly coupled to the first and second fluid lines 320, 325. The probe module 260 also includes a setting piston 392, which is operably coupled to the hydraulic fluid line 345 and the hydraulic fluid return line 350. The bypass valve system 390 is shown as part of the probe module 260, but the bypass valve system 390 may be implemented as a module that can be placed anywhere in the wireline tool 205 or elsewhere and/or duplicated. The bypass valve system 390 contributes, together with the field joint 230, to an adaptability of the wireline tool 205. The probe module 260 or other modules or downhole tools may employ a centralizing mechanism as described in more detail below.

Although not shown in FIG. 3, the wireline tool 205 may also include one or more sensors (or measurement devices), or a sensor (or a measurement) module having one or more sensors (or measurement devices), to measure or detect a fluid property. The fluid properties such as pressure, flow rate, resistivity, optical transmission or reflection, fluorescence, nuclear magnetic resonance ("NMR"), density, and viscosity are amongst the most used. A wireline tool may perform a sidewall coring function, a formation pressure test, a formation fluid sampling function, a seismic measurement, and to produce a perforation in the surrounding formation. A wireline tool may also exchange acoustic, nuclear, electrical, mechanical, and hydraulic energy with a surrounding formation.

As illustrated in FIG. 3, each module includes fluid and electrical lines that are connected when the wireline tool 205 is assembled. The illustrated embodiment includes four separate fluid lines, namely, the first and second fluid lines 320, 325, the hydraulic fluid line 345 and the hydraulic fluid return line 350. Additionally, the electrical line 310 extends through each module. While the electrical line 310 is illustrated in FIG. 3 with a single line, the wireline tool 205 may include multiple separate electrical wires or lines, each of which may have a separate function and may carry different voltages or amperages. Additionally, multiple redundant electrical lines may be provided to perform the same function. When multiple electrical lines are provided, there are multiple electrical connections that are made between the modules. Consequently, the connection interfaces or field joints 230 connect the segments of various fluid flow and electrical lines. Additionally, the electrical connections are isolated from one another and from the fluid lines to prevent inadvertent shorts, and to reduce or prevent fluid from contaminating the electrical connections. A wireline tool is introduced in U.S. Patent Application Publication No. 2009/0025926, by Briquet, et al., entitled "Field Joint for a Downhole Tool," published Jan. 29, 2009, which is incorporated herein by reference in its entirety.

Figure 4:
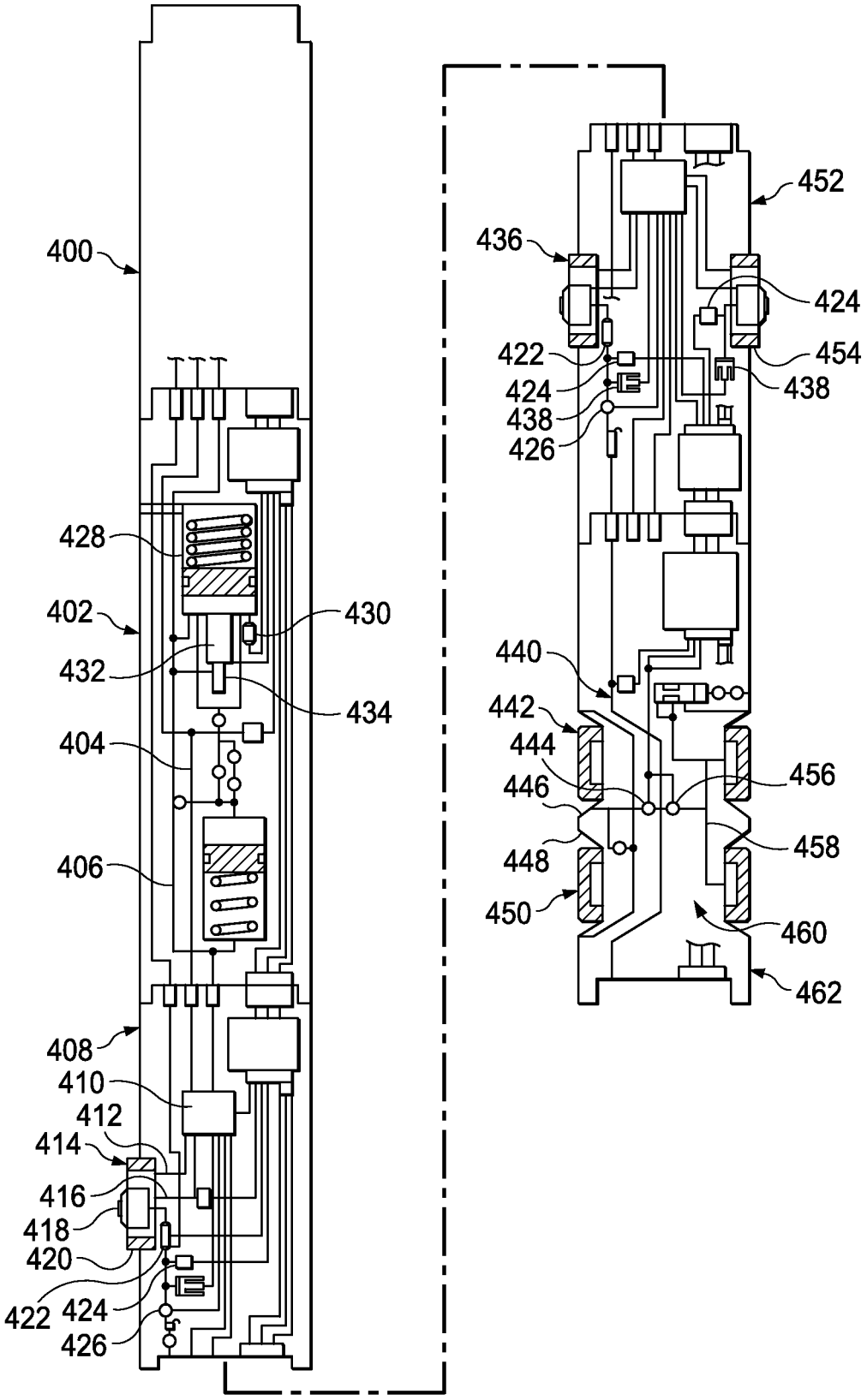
Figure 5:
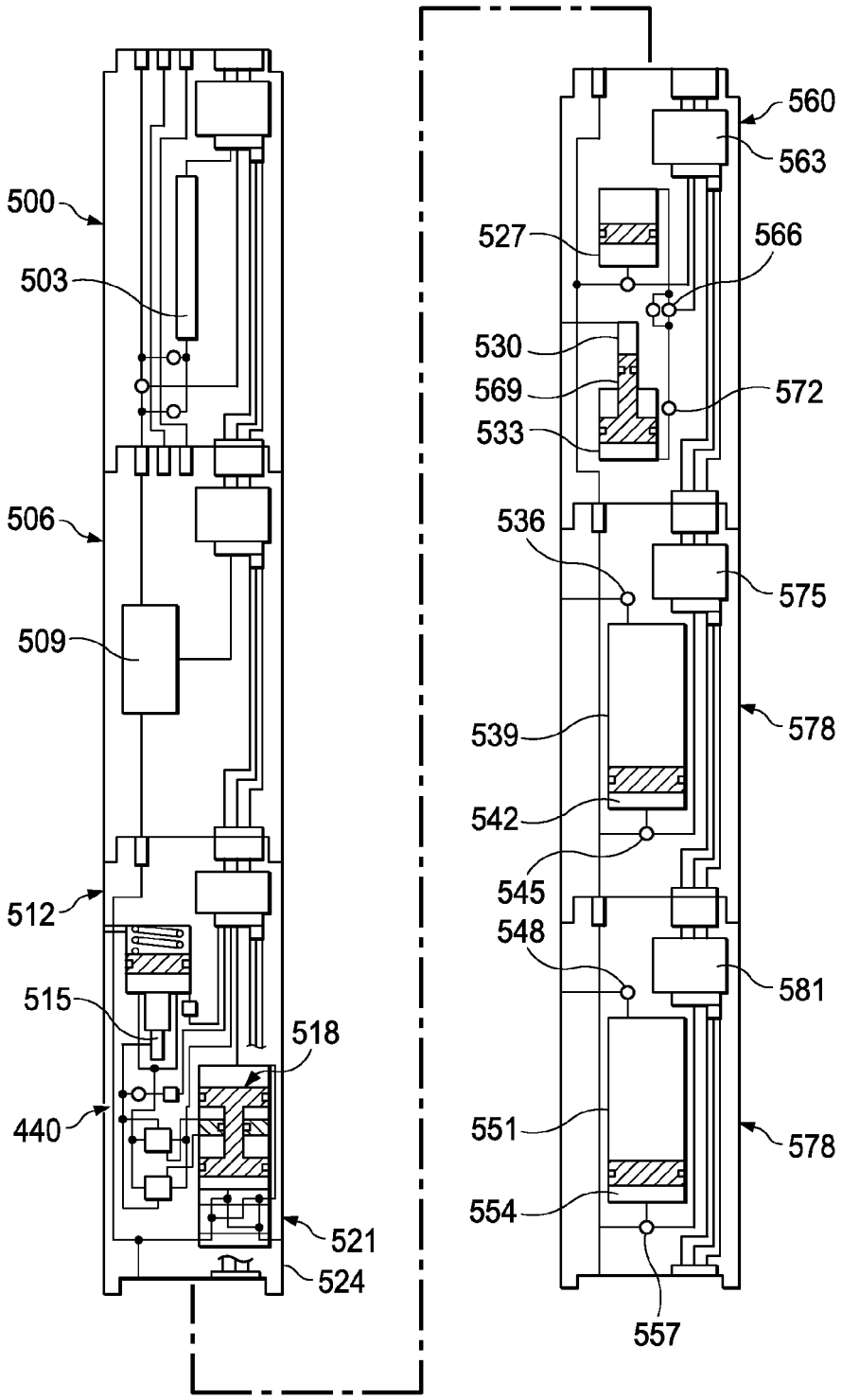

Referring to FIGS. 4 and 5, illustrated are schematic views of an apparatus or portions thereof according to one or more aspects of the present disclosure. The apparatus is a downhole tool that can be lowered into a wellbore (not shown) by a wireline (not shown) for conducting formation property tests. The wireline connections to the downhole tool as well as power supply and communications-related electronics are not illustrated herein.

The downhole tool includes a hydraulic module 402, a packer module 462 and a probe module/formation tester (referred to as a probe module) 408. The probe module 408 is shown with a probe assembly 414 that may be used for formation pressure tests, permeability tests or fluid sampling. The probe assembly 414 may be employed to isolate the formation from the wellbore. When using the downhole tool to determine anisotropic permeability and a vertical reservoir structure according to selected techniques, a multiprobe module/formation tester (referred to as a multiprobe module) 452 can be added to the downhole tool. The multiprobe module 452 includes a horizontal probe assembly 454 and a sink probe assembly 436.

The hydraulic module 402 includes a pump 434, a reservoir 428 and a motor 432 to control the operation of the pump 434. A low oil switch 430 also forms part of a control system and is used in regulating the operation of the pump 434. It should be noted that the operation of the pump 434 can be controlled by pneumatic or hydraulic means.

A hydraulic fluid line 404 is connected to the discharge of the pump 434 and runs through the hydraulic module 402 and into adjacent modules for use as a hydraulic power source. The hydraulic fluid line 404 may extend through the hydraulic module 402 into the packer module 462 via the probe module 408 and/or the multiprobe module 452 depending upon which configuration is used. A hydraulic loop is closed by virtue of a hydraulic fluid return line 406 that may extend from the probe module 408 back to the hydraulic module 402 and terminates at the reservoir 428.

A pump-out module 512 (see FIG. 5) can be used to dispose of unwanted samples by virtue of pumping fluid through a fluid line 440 into the wellbore, or may be used to pump fluids from the wellbore into the fluid line 440 to inflate straddle packers 442, 450. Furthermore, the pump-out module 512 may be used to draw formation fluid from the wellbore via the probe module 408 or the multiprobe module 452, and then pump the formation fluid into a sample chamber module 578 against a buffer fluid therein.

A bi-directional piston pump 518, energized by hydraulic fluid from a pump 515, can be aligned to draw from the fluid line 440 and dispose of the unwanted sample though a fluid line 524 or may be aligned to pump fluid from the wellbore (via the fluid line 524) to the fluid line 440. The pump-out module 512 has the control devices to regulate the bi-directional piston pump 518 and align the fluid line 440 with the fluid line 524 to accomplish the pump-out procedure. It should be noted here that the bi-directional piston pump 518 can pump samples into sample chamber module(s) 578, including overpressuring such samples, as well as to pump samples out of sample chamber module(s) 578 using the pump-out module 512. The pump-out module 512 may also be used to accomplish constant pressure or constant rate injection. With sufficient power, the pump-out module 512 may be used to inject fluid at high enough rates so as to enable creation of microfractures for stress measurement of the formation.

The straddle packers 442, 450 (see FIG. 4) can also be inflated and deflated with the pump-out module 512. As can be readily seen, selective actuation of the pump-out module 512 to activate the bi-directional piston pump 518 combined with selective operation of a control valve assembly 521 and inflation/deflation valves 460 can result in selective inflation or deflation of the straddle packers 442, 450. The straddle packers 442, 450 are mounted to an outer periphery 448 of the downhole tool, and are constructed of a resilient material compatible with wellbore fluids and temperatures. The straddle packers 442, 450 have a cavity therein. When the bi-directional piston pump 518 is operational and the inflation/deflation valves 460 are properly set, fluid from the fluid line 440 passes through the inflation/deflation valves 460, and through a fluid line 458 to the straddle packers 442, 450.

As illustrated in FIG. 4, the probe module 408 includes the probe assembly 414 that is selectively movable with respect to the downhole tool. The movement of the probe assembly 414 is initiated by operation of a probe actuator 410 that aligns the hydraulic fluid lines 404, 406 with the fluid lines 412, 416. A probe (or feature) 418 is mounted to a frame 420 that is movable with respect to the downhole tool, and the probe 418 is movable with respect to the frame 420. The probe module 408 or other modules or downhole tools may employ a centralizing mechanism as described in more detail below. These relative movements are initiated by the probe actuator 410 by directing fluid from the hydraulic fluid lines 404, 406 selectively into the fluid lines 412, 416 with the result being that the frame 420 is initially outwardly displaced into contact with the wellbore wall (not shown). The extension of the frame 420 helps to steady the downhole tool during use and brings the probe 418 adjacent or in physical interface with the sidewall of the wellbore. To obtain an accurate reading of pressure in the formation, which pressure is reflected at the probe 418, the probe 418 may be further inserted through a built up mudcake and into contact with the formation. Thus, alignment of the hydraulic fluid line 404 with the fluid line 416 results in a relative displacement of the probe 418 into the formation by relative motion of the probe 418 with respect to the frame 420. The operation of the sink and horizontal probe assemblies 436, 454 is similar to that of the probe assembly 414.

Having inflated straddle packers 442, 450 and set the probe 418 and/or the sink and horizontal probe assemblies 436, 454, the fluid withdrawal testing of the formation can begin. The fluid line 440 extends from the probe 418 in the probe module 408 down to the outer periphery 448 at a point between the straddle packers 442, 450 through adjacent modules and into the sample chamber modules 578. The probe 418 and/or the sink and horizontal probe assemblies 436, 454 allow entry of the formation fluids into the fluid line 440 via one or more of a resistivity measurement device 422, a pressure measurement device 424, and a pretest mechanism 438, according to a configuration. When using the probe module 408 and/or the multiprobe module 452, an isolation valve 426 is mounted downstream of the resistivity measurement device 422. In the closed position, the isolation valve 426 limits the internal fluid line volume, improving the accuracy of dynamic measurements made by the pressure measurement device 424. After initial pressure tests are made, the isolation valve 426 can be opened to allow flow into other modules.

When taking initial samples, there is a high prospect that the formation fluid initially obtained is contaminated with mudcake and filtrate, which may be purged from the sample flow stream prior to collecting the sample(s). Accordingly, the pump-out module 512 is used to initially purge from the downhole tool specimens of formation fluid taken through an inlet 446 of the straddle packers 442, 450, or the probe 418, or the sink and horizontal probe assemblies 436, 454 into the fluid line 440.

A fluid analysis module 506 includes an optical fluid analyzer 509 for bindicating where the fluid in the fluid line 440 is acceptable for collecting a high quality sample. The optical fluid analyzer 509 is equipped to discriminate between various oils, gas and water (see, e.g., U.S. Pat. No. 4,994,671, issued to Safinya, et al., entitled "Apparatus and Method for Analyzing the Composition of Formation Fluids," issued Feb. 19, 1991, U.S. Pat. No. 5,166,747, issued to Schroeder, et al., entitled "Apparatus and Method for Analyzing the Composition of Formation Fluids," issued Nov. 24, 1992, U.S. Pat. No. 5,939,717, issued to Mullins, entitled "Methods and Apparatus for Determining Gas-Oil Ratio in a Geological Formation Through the Use of Spectroscopy," issued Aug. 17, 1999 and U.S. Pat. No. 5,956,132, issued to Donzier, entitled "Method and Apparatus for Optically Discriminating Between the Phases of a Three-Phase Fluid," issued Sep. 21, 1999, which are incorporated herein by reference in their entirety).

While flushing out the contaminants from the downhole tool, formation fluid can continue to flow through the fluid line 440 that extends through adjacent modules such as a precision pressure module 500, the fluid analysis module 506, the pump-out module 512, a flow control module 560, and any number of the sample chamber modules 578 that may be attached. By having a fluid line 440 running the length of various modules, multiple sample chamber modules 578 can be stacked without increasing the overall diameter of the downhole tool.

The flow control module 560 includes a flow sensor (or measurement device) 572, a flow controller 563 and a selectively adjustable restriction device such as a valve 566. A predetermined sample size can be obtained at a specific flow rate by use of the equipment in conjunction with reservoirs 527, 530, 533. The reservoir 533 is pressure balanced with approximately one-third wellbore pressure, by way of a piston 569 and the reduced diameter of the reservoir 530 relative to the reservoir 533. This is one example wherein wellbore fluid is used as a buffer fluid to control the pressure of the fluid in the fluid line 440 and the pressure of a sample being taken.

The sample chamber module 578 can then be employed to collect a sample of the fluid delivered via the fluid line 440 where the piston motion is controlled via the buffer fluid from the non-sample side of the piston being regulated by the flow control module 560. With reference first to an upper sample chamber module 578 in FIG. 5, a shut-off valve 545 is opened, and the isolation valve 426 and isolation valves 444, 456 are held closed, thus directing the formation fluid in the fluid line 440 into a sample collecting cavity 542 in a sample chamber 539 of the upper sample chamber module 578, after which the shut-off valve 545 is closed to isolate the sample. The downhole tool can then be moved to a different location and the process repeated. Additional samples taken can be stored in any number of additional sample chamber modules 578 that may be attached by suitable alignment of valves. For example, there are two sample chambers modules 578 illustrated in FIG. 5.

After having filled the upper sample chamber module 578 by operation of the shut-off valve 545, the next sample can be stored in a lower sample chamber module 578 by opening a shut-off valve 557 connected to sample collecting cavity 554 of a sample chamber 551. It should be noted that each sample chamber module 578 has its own control assembly 575, 581. Any number of sample chamber modules 578, or no sample chamber modules, can be used in particular configurations of the downhole tool depending upon the nature of the test to be conducted. Also, the sample chamber module 578 may be a multi-sample chamber module that houses a plurality of sample chambers.

It should also be noted that the buffer fluid in the form of full-pressure wellbore fluid may be applied to the backsides of the pistons in the sample chambers 539, 551 to further control the pressure of the formation fluid being delivered to the sample chamber modules 578. In accordance therewith, valves 536, 548 are opened, and the bi-directional piston pump 518 of the pump-out module 512 can pump the fluid in the fluid line 440 to a pressure exceeding wellbore pressure. It has been discovered that this action has the effect of dampening or reducing the pressure pulse or "shock" experienced during drawdown. This low shock sampling method has been used in obtaining fluid samples from unconsolidated formations. In conjunction with an electric power module 400, various configurations of the downhole tool can be employed depending upon the function (e.g., basic sampling, reservoir pressure determination, uncontaminated sampling at reservoir conditions, simulated drill stem testing) to be accomplished. The downhole tool can be of unitary construction as well as modular construction.

As mentioned above, the fluid line 440 also extends through the precision pressure module 500. A precision gauge 503 of the precision pressure module 500 may be mounted as close to the sink and horizontal probe assemblies 436, 454 (or the probe 418) as possible to reduce internal fluid line length that, due to fluid compressibility, may affect pressure measurement responsiveness. The precision gauge 503 is more sensitive than the pressure measurement device 424 for more accurate pressure measurements with respect to time. The precision gauge 503 may be a quartz pressure gauge that performs the pressure measurement through the temperature and pressure dependent frequency characteristics of a quartz crystal, which is more accurate than the comparatively simple strain measurement that a strain gauge employs. Suitable valving of the control mechanisms can also be employed to stagger the operation of the pressure measurement device 424 and the precision gauge 503 to take advantage of their difference in sensitivities and abilities to tolerate pressure differentials.

The individual modules of downhole tool are constructed so that they quickly connect to each other. Flush connections between the modules may be used in lieu of male/female connections to avoid points where contaminants, common in a wellsite environment, may be trapped. Flow control during sample collection allows different flow rates to be used. Flow control is useful in getting meaningful formation fluid samples as quickly as possible that reduces the chance of sticking the wireline and/or the downhole tool because of mud oozing into the formation in high permeability situations. In low permeability situations, flow control is very helpful to prevent drawing formation fluid sample pressure below its bubble point or asphaltene precipitation point.

More particularly, the "low shock sampling" method is useful for reducing the pressure drop in the formation fluid during drawdown so as to reduce the "shock" on the formation. By sampling at a lower pressure drop, the likelihood of keeping the formation fluid pressure above asphaltene precipitation point pressure as well as above bubble point pressure is also increased. In one method of achieving a reduced pressure drop, the sample chamber is maintained at wellbore hydrostatic pressure as described above, and the rate of drawing connate fluid into the downhole tool is controlled by monitoring the tool's inlet fluid line pressure via the pressure measurement device 424 and adjusting the formation fluid flow rate via the bi-directional piston pump 518 and/or the flow control module 560 to induce a reduced drop in the monitored pressure that produces fluid flow from the formation. In this manner, the pressure drop is reduced through regulation of the formation fluid flow rate. For a better understanding of the modules of the downhole tool, see U.S. Pat. No. 7,243,536, issued to Bolze, et al., entitled "Formation Fluid Sampling Apparatus and Method," issued Jul. 17, 2007, which is incorporated herein by reference in its entirety.

Figure 6:
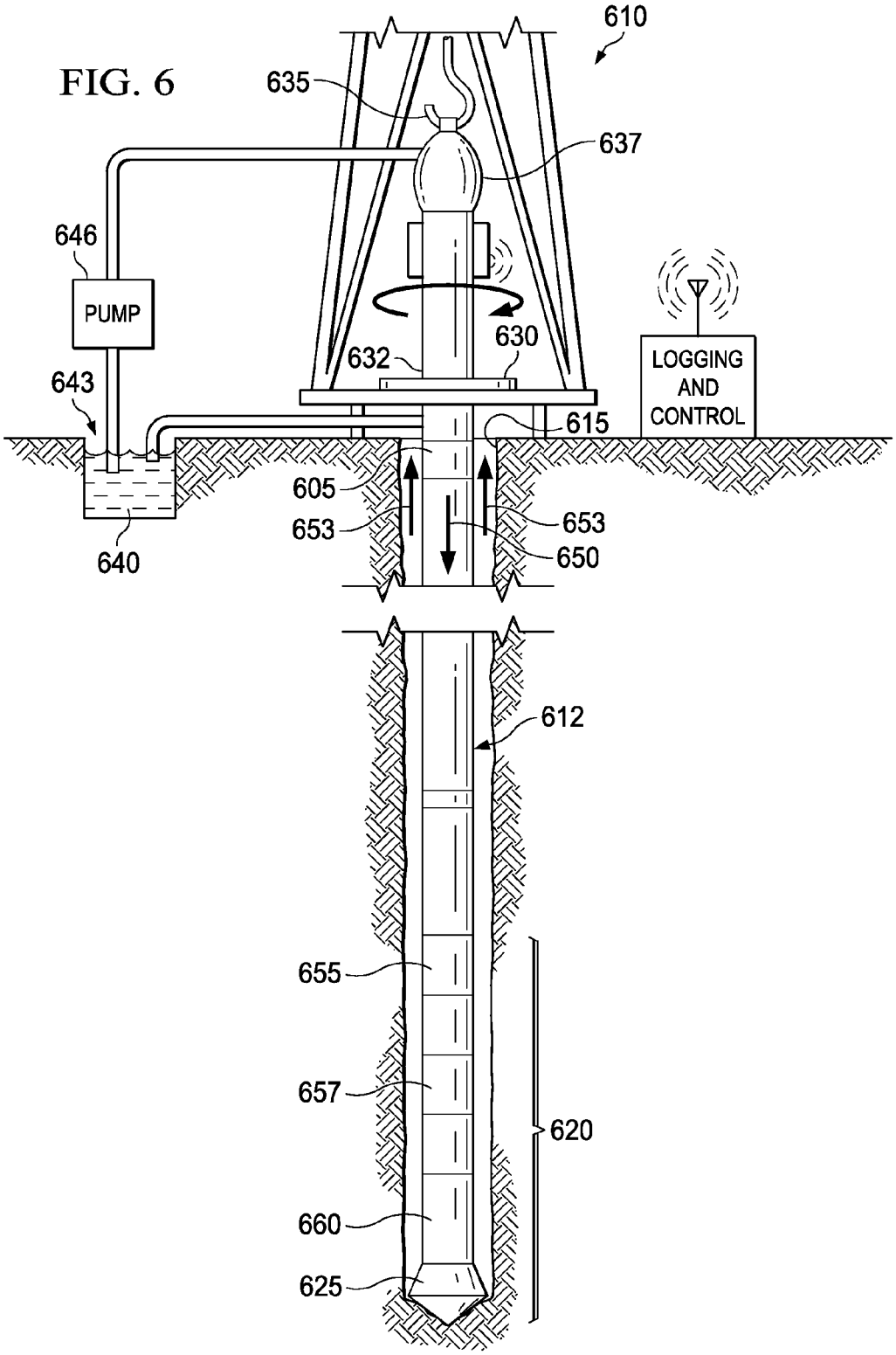

Referring to FIG. 6, illustrated is a schematic view of an apparatus or portions thereof according to one or more aspects of the present disclosure. The apparatus includes a drill string 605 deployed from a platform (also referred to as a platform and derrick assembly) 610 that provides an environment for application of one or more aspects of the present disclosure. The platform 610 and drill string 605 may be a part of an onshore or offshore well site. In this well site, a wellbore 615 is formed in subterranean formations by rotary drilling, which may also include directional drilling.

The drill string 605 is suspended within the wellbore 615, and includes a plurality of drill pipes (one of which is designated 612) and a bottom hole assembly 620 with a drill bit 625 at its lower end. The platform 610 is positioned over the wellbore 615 and includes a rotary table 630, a kelly 632, a hook 635 and a rotary swivel 637. The drill string 605 is rotated by the rotary table 630, energized by means not shown, which engages the kelly 632 at the upper end of the drill string 605. The drill string 605 is suspended from the hook 635, attached to a traveling block (also not shown) through the kelly 632 and the rotary swivel 637, which permits rotation of the drill string 605 relative to the hook 635. A topdrive may also be used.

At the surface of the well site, drilling fluid (or mud) 640 is stored in a pit (or tank) 643. A pump 646 delivers the drilling fluid 640 to the interior of the drill string 605 via a port in the rotary swivel 637, causing the drilling fluid 640 to flow downwardly through the drill string 605 as indicated by the directional arrow 650. The drilling fluid 640 exits the drill string 605 via ports in the drill bit 625 and then circulates upwardly through the annulus region between the outside of the drill string 605 and the wall of the wellbore 615, as indicated by the directional arrows 653. The drilling fluid 640 lubricates the drill bit 625 and carries formation cuttings up to the surface as it is returned to the pit 643 for recirculation.

The bottom hole assembly 620 is constructed with an LWD module (one of which is designated 655), a measurement while drilling ("MWD") module (one of which is designated 657), a roto-steerable system and motor 660 and the drill bit 625. The LWD module 655 is housed in a special type of drill collar, and can contain one or a plurality of types of logging tools. It will also be understood that more than one LWD module 655 and/or MWD module 657 can be employed. The LWD module 655 may include capabilities for measuring, processing and storing information, as well as for communicating with the surface equipment. In the present embodiment, the LWD module 655 includes, without limitation, a fluid-sampling device or a pressure measurement device.

The MWD module 657 is also housed in a special type of drill collar, and can contain one or more devices for measuring characteristics of the drill string 605 and drill bit 625. The well site further includes power equipment (not shown) for generating electrical power to the drill string 605. While this may include a mud turbine generator powered by the flow of the drilling fluid, it should be understood that other power and/or battery systems may be employed. In the present embodiment, the MWD module 657 includes, without limitation, one or more measuring devices such as a weight-on-bit measuring device, a torque measuring device, a vibration measuring device, a shock measuring device, a stick slip measuring device, a direction measuring device and an inclination measuring device.

Figure 7:
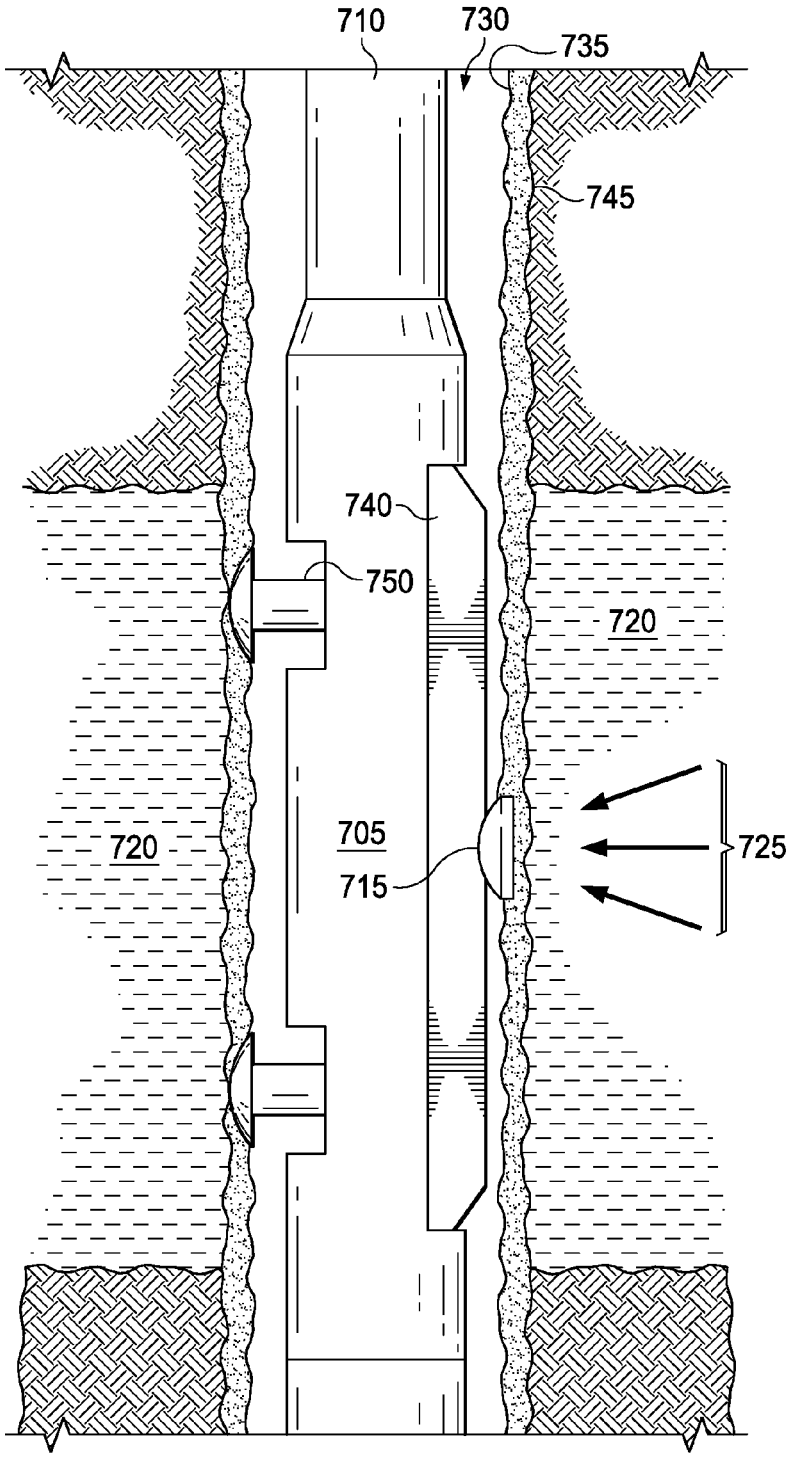

Referring to FIG. 7, illustrated is a schematic view of an apparatus or portions thereof according to one or more aspects of the present disclosure. The apparatus includes an LWD module 705 coupled to a drill collar 710 that provides an environment for application of one or more aspects of the present disclosure. As an example, an LWD module is described in U.S. Pat. No. 7,114,562, issued to Fisseler, et al., entitled "Apparatus and Method for Acquiring Information While Drilling," issued Oct. 3, 2006, which is incorporated herein by reference in its entirety. The LWD module 705 is provided with a probe (or feature) 715 for establishing fluid communication with the surrounding subterranean formation and drawing a fluid 720 into the LWD module 705, as indicated by the arrows 725. A fluid can also be injected into the surrounding subterranean formation. The probe 715 may be employed to isolate the formation from the wellbore.

As illustrated in FIG. 7, the wellbore 730 is lined with a mudcake 735. The probe 715 may be positioned in a stabilizer blade 740 of the LWD module 705 and extended therefrom to engage a sidewall 745 of the wellbore 730. The stabilizer blade 740 may include one or more blades that are in contact with the sidewall 745 of the wellbore 730. The fluid 720 drawn into the LWD module 705 using the probe 715 may be measured to determine, for example, reservoir parameters. Additionally, the LWD module 705 may be provided with devices, such as sample chambers, for collecting samples of fluid 720 for retrieval at the surface. Setting pistons (one of which is designated 750) may also be provided to assist in applying force to push the LWD module 705 and/or probe 715 against the sidewall 745 of the wellbore 730. Additionally, the LWD module 705 or other modules or downhole tools may employ a centralizing mechanism as described in more detail below.

Figure 8:
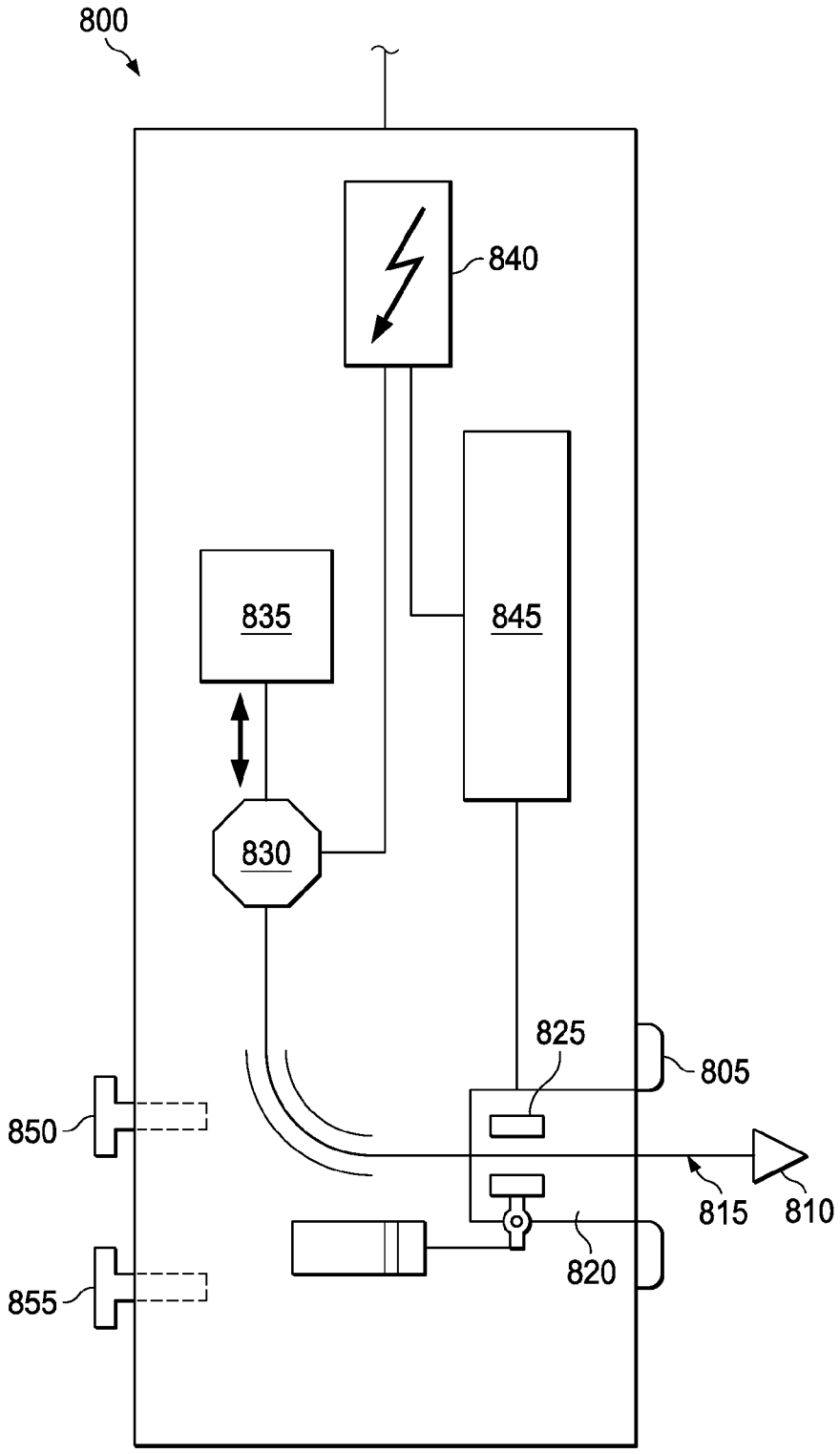

Referring to FIG. 8, illustrated is a schematic view of an apparatus or portions thereof according to one or more aspects of the present disclosure. The apparatus includes a downhole sampling tool 800 having formation drilling means. The downhole sampling tool 800 includes a drill bit (or feature) 810 having a drill shaft 815. The drill shaft 815 may be provided via a shaft guide 825. The drill bit 810 is driven by a motor 830. The motor 830 and the drill shaft 815 can be extended from or retracted into the downhole sampling tool 800 with the displacement mechanism 835. The displacement mechanism 835 comprises, for example, a rotative motor coupled to a lead screw. The drill bit 810 and drill shaft 815 are surrounded by a packer 805. The packer 805 may be placed into sealing engagement with the sidewall of the wellbore (not shown) by activating the setting pistons 850, 855. Additionally, the downhole sampling tool 800 may be equipped with an extendable packer mounted on a backing plate. As will be appreciated by those skilled in the art, formation fluids can flow through the annulus 820 between the drill shaft 815 and the packer 805 into the downhole sampling tool 800. In this example, a pump 845 is used to generate a pressure differential between the downhole sampling tool 800 and the formation. Thus, the flow of formation fluids is enhanced by increasing a pressure differential.

As shown in FIG. 8, the motor 830 is powered by a power supply 840 which may also include power heating elements (not shown) and the pump 845 for collecting formation fluids. The power supply 840 may comprise, for example, a powerful chemical source such as a battery or a fuel cell, an alternator driven by a turbine, which itself is driven by the flow of circulating formation fluids as in the case of a drilling-type tool, etc. A power supply 840 may not be needed if the power requirements can be met by the up-hole equipment and conducted to the downhole sampling tool 800 via, for example, a cable that suspends it.

While not shown in FIG. 8, the downhole sampling tool 800 can include a plurality of drill bits with one or more of the bits having a heating element thereon. In addition, the downhole sampling tool 800 can be provided with functional aspects including, but not limited to, fluid mobility enhancers, multiple pumps, containers, valves, a fluid analyzer, etc. Also, some components of downhole sampling tool 800 may be used for energizing and deploying drill bits. Additionally, the downhole sampling tool 800 or other modules and downhole tools may employ a centralizing mechanism as described in more detail below.

Figure 9:
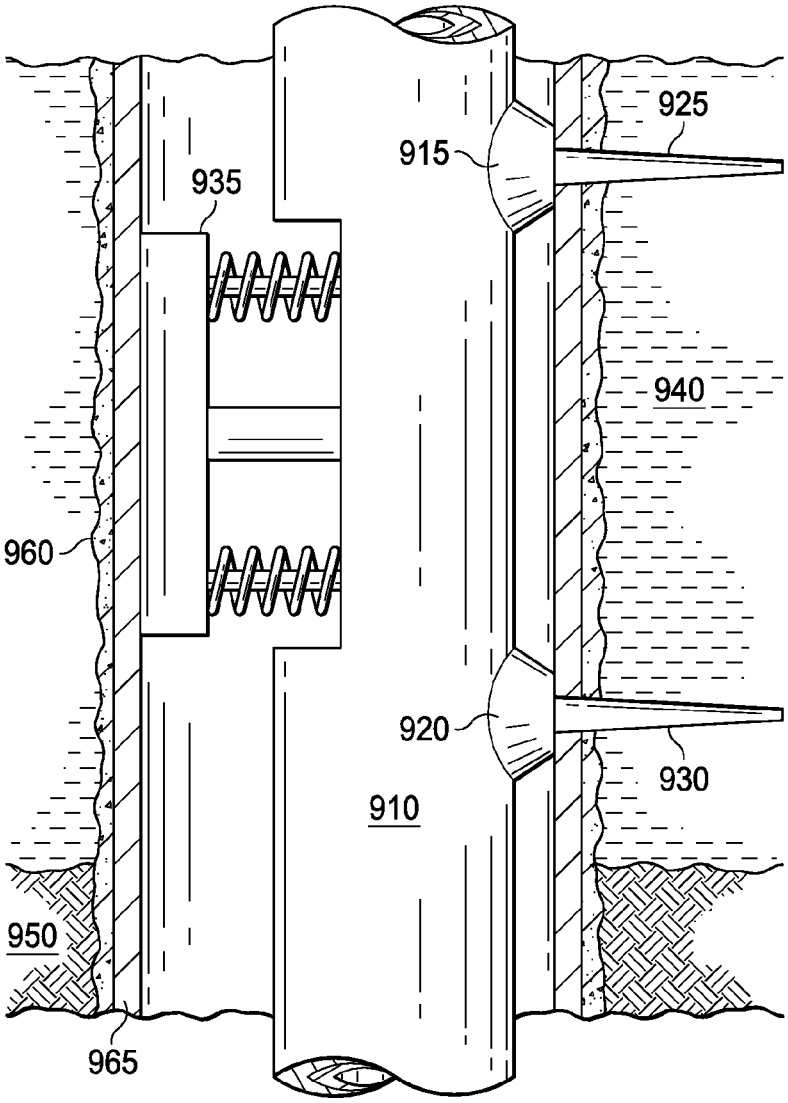

Referring to FIG. 9, illustrated is a schematic view of an apparatus shown in an operative position in a wellbore according to one or more aspects of the present disclosure. The apparatus includes a downhole sampling tool 910. While a wellbore 960 encased with an encasing sidewall 965 is shown in FIG. 9, it will be appreciated that the wellbore 960 may be open. Thus, the wellbore 960 may be provided with the encasing sidewall 965 suitably cemented to the wellbore 960 and, in the extended position of the wall-engaging member 935, fluid sampling means (or features) 915, 920 physically interface in sealing engagement with the encasing sidewall 965. In this position, explosive means in the testing section which are associated with the sampling means 915, 920 may be employed to perforate the surrounding earth formation, thereby permitting formation fluids from the surrounding earth formation to flow from the testing section 940 into the downhole sampling tool 910. It will be noted that the dual perforations 925, 930 produced by the explosive means are spaced in depth along the wellbore 960, thereby permitting an interval along the surrounding formations to be sampled. Thus, a greater area of the surrounding earth formations is sampled, which decreases the possibility of missing a permeable zone and increases the reliability of obtaining a fluid sample at the testing section 940. Additionally, the downhole sampling tool 910 or other modules and downhole tools may employ a centralizing mechanism as described in more detail below.

Figure 10:
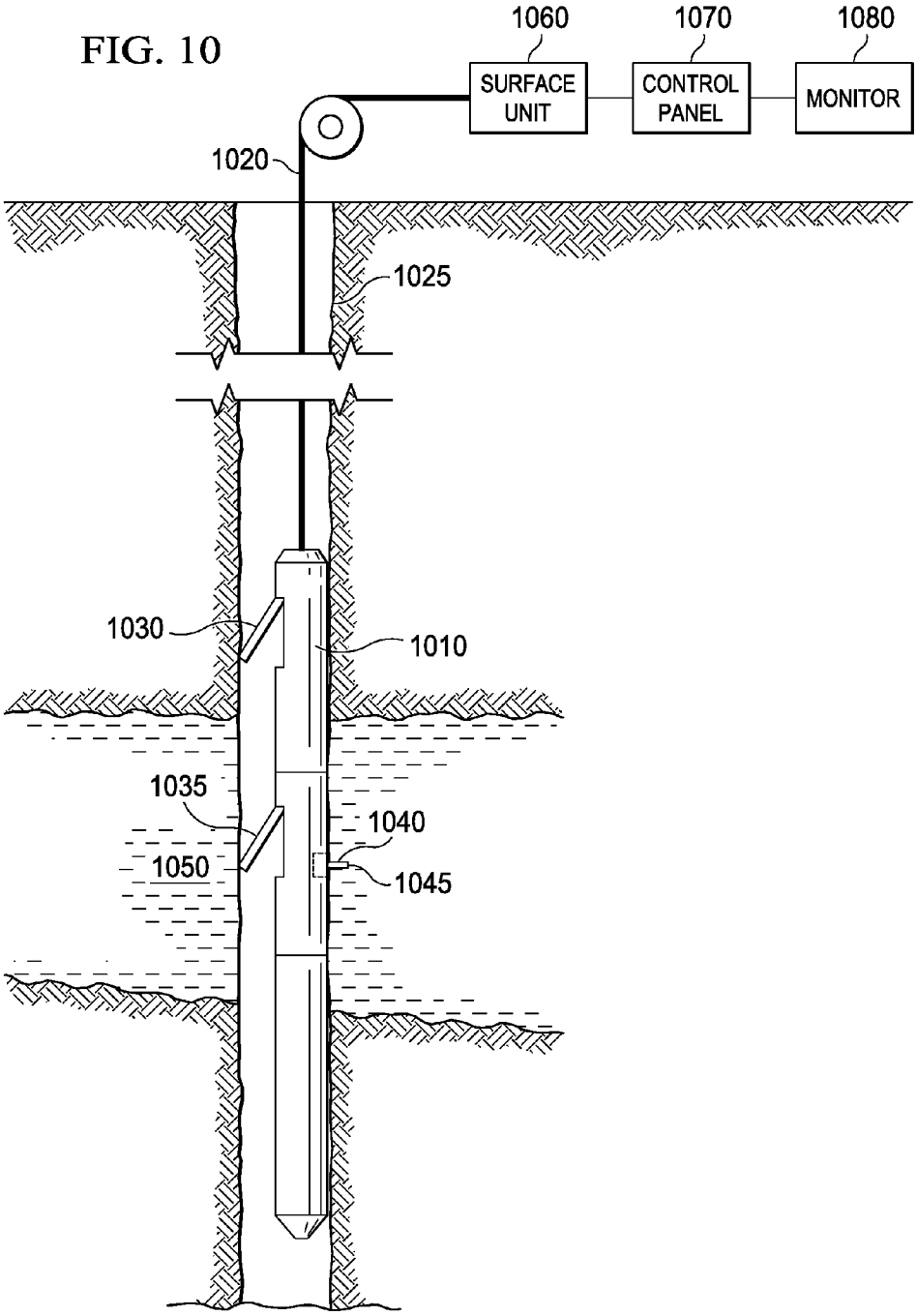
Figure 11:
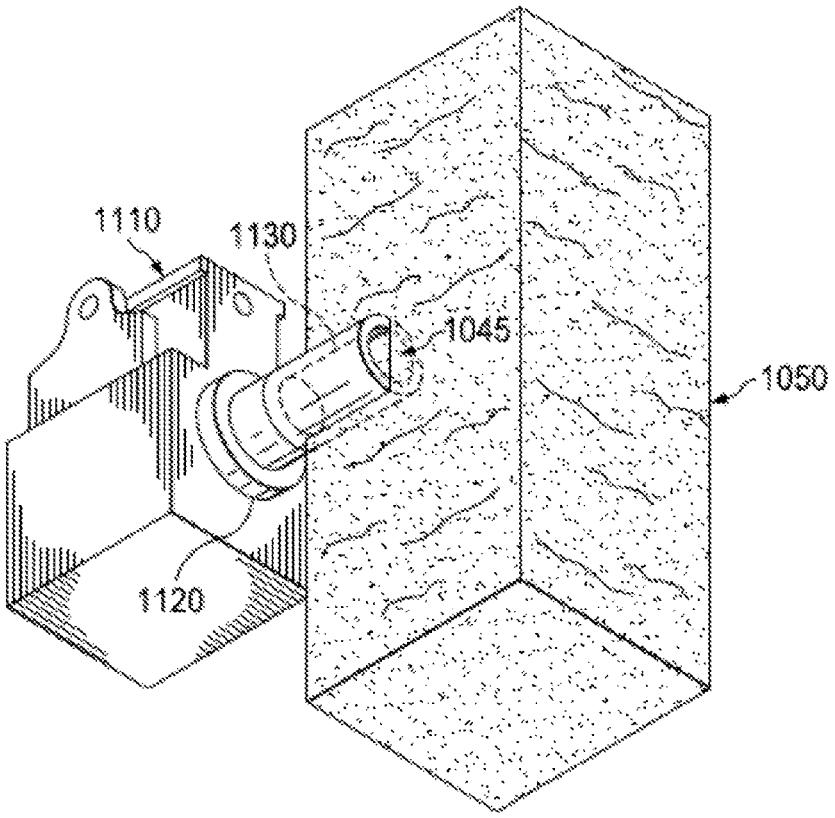

Referring to FIGS. 10 and 11, illustrated are schematic views of apparatus or portions thereof according to one or more aspects of the present disclosure. The apparatus includes a downhole coring tool 1010 in use in a drilled wellbore and shows the general features of the coring tool for coring a downhole geologic formation. The downhole coring tool 1010 is lowered into the wellbore defined by the wellbore sidewall 1025. The downhole coring tool 1010 is connected by one or more electrically conducting cables 1020 to a surface unit 1060 that includes a control panel 1070 and a monitor 1080. The surface unit 1060 may provide electrical power to the downhole coring tool 1010, to monitor the status of downhole coring and activities of other downhole equipment, and to control the activities of the downhole coring tool 1010 and other downhole equipment. The downhole coring tool 1010 is generally contained within an elongate housing suitable for being lowered into and retrieved from a slim wellbore.

The downhole coring tool 1010 contains a coring assembly generally comprising a motor 1110, a coring bit (or feature) 1040 having a distal, open end 1045 for cutting and receiving the core sample, and a mechanical linkage for deploying and retracting the coring bit 1040 from and to the downhole coring tool 1010 and for rotating the coring bit 1040 against the wellbore sidewall 1025. FIG. 10 shows the downhole core tool 1010 in its active, cutting configuration. The downhole coring tool 1010 is positioned adjacent to the target geologic formation 1050 and secured firmly against the wellbore sidewall 1025 using anchoring shoes 1030, 1035 extended from the opposing side of the downhole coring tool 1010 from the coring bit 1040. The distal, open end 1045 of the coring bit 1040 is rotated against the target geologic formation 1050 to cut the core sample 1130. Additionally, the downhole coring tool 1010 or other modules and downhole tools may employ a centralizing mechanism as described in more detail below.

FIG. 11 shows a perspective view of the coring bit 1040 after it has cut into the target geologic formation 1050. The coring bit 1040 is fixedly connected to a base 1120 which is, in turn, connected to and turned by a coring motor 1110. The core sample 1130 is received into the hollow interior of the coring bit 1040 as cutting progresses.

Conventional coring bits 1040 used in rotary cutting of core samples 1130 from geologic formations 1050 are generally constructed of very rigid materials such as steel, and often have particles of very hard materials embedded in the circumferential cutting edge of the coring bit 1040. These hard materials may cut a circumferential groove around a core sample 1130. The core sample 1130 is approximately one inch in diameter and the coring bit 1040 cuts approximately one to two inches into the wellbore sidewall 1025, thereby creating a protruding cylindrical core sample 1130 that can be broken from the formation and retrieved to the surface for analysis. It should be noted that the actual size of a core sample 1130 may vary widely.

Figure 12:
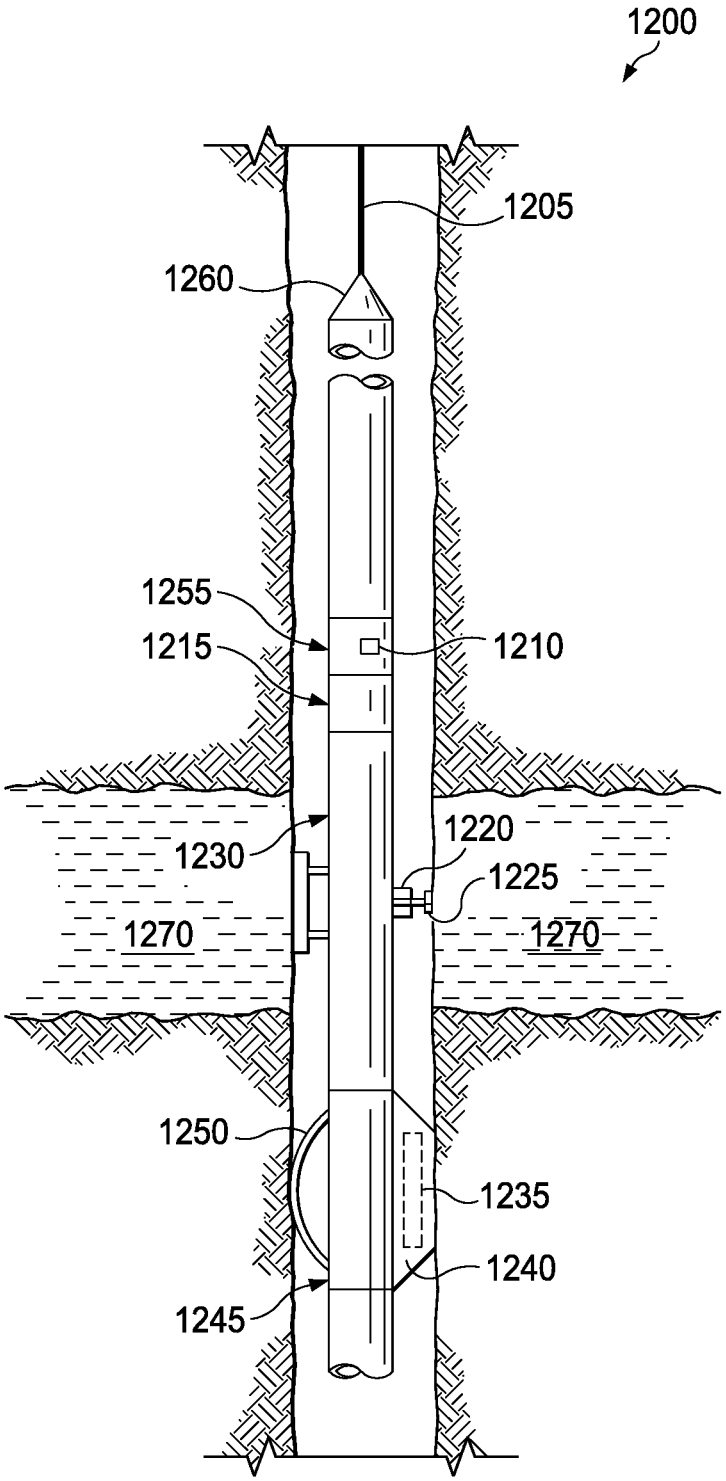

Referring to FIG. 12, illustrated is a schematic view of an apparatus or portions thereof according to one or more aspects of the present disclosure. The apparatus is a downhole tool 1200 that is provided with means for steering a nuclear magnetic resonance ("NMR") sensor (or feature) 1235 along a particular azimuth. As shown, the downhole tool 1200 is conveyed via wireline cable 1205 in a wellbore drilled through an underground formation 1270.

To provide inclinometry measurements, the downhole tool 1200 is provided with an inclinometry tool 1215, similar to the General Purpose Inclinometry Tool 527 described in U.S. Patent Application Publication Number 2010/0264915, to Saldungaray, et al., entitled "Formation Testing and Evaluation using Localized Injection," published Oct. 21, 2010, which is incorporated herein by reference in its entirety. To provide electrical power, telemetry with a surface unit, and downhole processing, the downhole tool 1200 includes a telemetry module 1255. In addition, the telemetry module 1255 may include a natural gamma ray sensor 1210. The natural gamma ray sensor 1210 may be used to generate an image of the formation 1270. This image may in turn be used to derive a correlation between axial positions of the downhole tool 1200 and geological features of the formation 1270 that have been identified in the image generated by the gamma ray sensor 1210. The derived correlation may consequently be used to precisely position or reposition the downhole tool 1200 in the wellbore.

To inject fluid into the formation 1270, the downhole tool 1200 is provided with a probe module/formation tester module ("probe module") comprising a pump module 1230 having an extendable probe assembly (or probe) 1220 for sealing off a portion of the wellbore sidewall, and sample chambers (not shown) for conveying injection fluid downhole. The probe assembly 1220 may be provided with a drilling or coring tool 1225 protruding from the sealed off a portion of the wellbore sidewall for perforating an impermeable mudcake that may eventually isolate the wellbore from the formation 1270. Fluid injection into the formation 1270 may use a low speed pump to ensure a sufficiently low injection flow rate and/or a sufficient low injection pressure to avoid losing the seal provided by the probe assembly 1220.

To perform measurement on the formation 1270, before and/or after injection and, in particular, to derive residual oil saturation, the downhole tool 1200 is provided with an NMR tool 1245 and having the NMR sensor 1235 similar to the NMR sensor of the NMR tool 541 described in U.S. Patent Application Publication Number 2010/0264915, previously cited herein. The NMR sensor 1235 is disposed in a pad 1240 that is applied against the formation 1270 by a bow spring 1250. In the embodiment of FIG. 12, the NMR pad 1240 and the bow spring 1250 may be used to steer the downhole tool 1200 along a particular azimuth, maintaining thereby the angular position agreement of the NMR sensor 1235 with the probe assembly 1220. In addition, reducing the amount of torque transmitted from the wireline cable 1205 to the downhole tool 1200 with a swivel 1260 also facilitates maintaining the angular position agreement of the NMR sensor 1235 with the probe assembly 1220. Finally, an operator at the surface may check that the angular position agreement has been maintained during extending the wireline cable 1205 by monitoring, for example, the orientation of the downhole tool 1200 determined by the magnetometers provided by the inclinometry tool 1215. Additionally, the downhole tool 1200 or other modules and downhole tools may employ a centralizing mechanism as described in more detail below.

Figure 13:
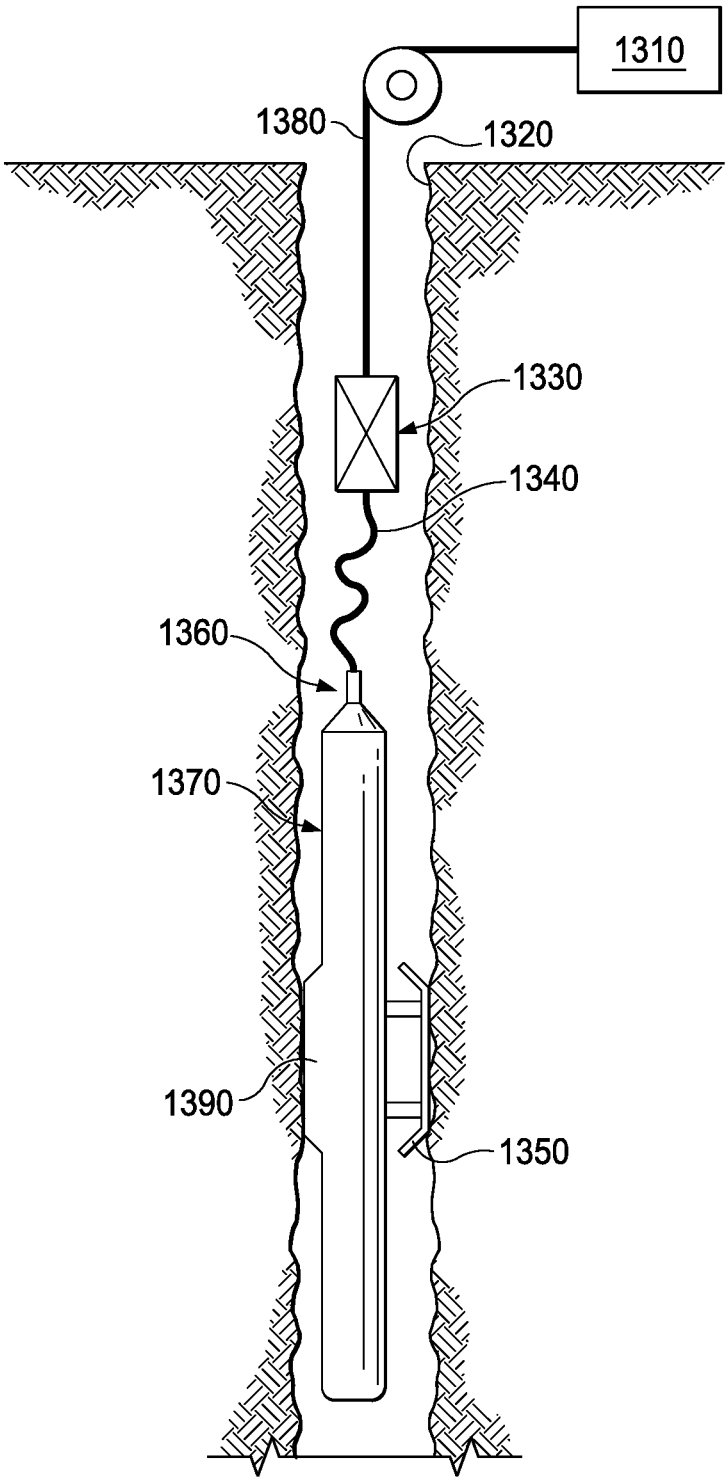

Referring to FIG. 13, illustrated is a schematic view of an apparatus or portions thereof according to one or more aspects of the present disclosure. The apparatus is a downhole seismic logging tool. A seismic source 1360 is disposed in a wellbore 1320, which passes through underground formations to be analyzed. Depending on the measurement technique used, receivers (not shown) may be placed in adjacent wellbores (cross-well technique) or on the surface of the ground (reverse vertical seismic profiling technique). In operation, the seismic source 1360 may be actuated successively at different depths and the signals detected by the receivers are analyzed to determine the characteristics of the various reflecting interfaces in the formations surrounding the wellbore 1320.

The seismic source 1360 comprises a main module 1370 that contains the source and has a surface (or feature) 1390 to be clamped in the wellbore 1320 by clamping means 1350. Above the main module 1370, the seismic source 1360 also comprises an electronic control module 1330, which is connected to the main module 1370 by a cable 1340 which is slack when the clamping means 1350 is in action. The slack in the cable 1340 provides mechanical decoupling between the main module 1370 and the electronic control module 1330, thereby reducing the mass and the length of the active portion of the source. Additionally, the downhole seismic logging tool or other modules and downhole tools may employ a centralizing mechanism as described in more detail below.

The electronic control module 1330 controls the seismic source 1360 according to information transmitted from an electronic unit 1310 situated on the surface. Signal transmission from the electronic unit 1310 to the electronic control module 1330 takes place via a cable 1380. The signals that control the seismic source 1360 may originate from a processor unit (not shown) disposed in the control module 1330 or another downhole unit.

Several types of seismic sources have been developed. The sources include impulsive sources, sweep frequency sources, and piezoelectric sources. In accordance with one embodiment, a seismic source is based on the impulsive mechanism. For example, an acoustic signal may be generated by a piston striking a plate. The shock waves generated from such impact are then transmitted into the wellbore and the surrounding formation.

As described herein, a centralizing mechanism for a module of a downhole tool centralizes the module in a wellbore during setting, which may produce better sealing of packers of a probe, or coupling of other features of the module to the sidewall of the wellbore. The probe or other feature of the module may be constructed with a telescopic piston and both inner and outer packers so that the formation can be isolated from the wellbore by extending the probe from the module against the sidewall of the wellbore and compressing the packers against the sidewall of the wellbore. The probe or other feature can add or remove material from the formation about the sidewall of the wellbore. For example, a coring tool with a bit can drill or core into the formation by extending the drill bit into the formation and rotating it. As a coring or perforating tool, a better centralized module may permit alignment of a feature of the module perpendicularly to the sidewall of the wellbore, and the module can obtain a straighter core sample or a more accurately positioned formation perforation. The probe or other feature can also transfer energy between the formation and the downhole tool. For example and without limitation, acoustic, electromagnetic, nuclear, electrical, mechanical, or hydraulic energy can be transferred. Thus, the probe or other feature can be constructed, without limitation, as part of a sidewall coring tool, a formation pressure testing tool, a formation fluid sampling tool, a nuclear magnetic resonance tool, a seismic tool, and/or a formation perforating tool. The centralizing mechanism can be employed with a tool deployed in a wellbore with any means of conveyance.

The downhole tool may include, for example and without limitation, a modular retrievable packer (such as a SCHLUMBERGER "Quicksilver Probe" or other focused sampling probe), a probe module hydraulic module ("MRHY"), a modular retrievable packer pump-out module ("MRPO"), a multi-sample module ("MRMS"), an electronics module ("MRPC"), a probe module/formation tester that performs various tests and functionalities, as well as other module types. The tool may also be provided with a telemetry cartridge ("EDTC") and a logging head ("LEH"). Some of these functionalities are described hereinabove with, for instance, reference to the probe modules above.

When a focused sampling probe (e.g., a Quicksilver probe) or other downhole tool is set in a wellbore, particularly in a non-vertically bored wellbore larger than about 12 inch diameter, the downhole tool tends to lie off-center in the wellbore with one side of the packer barely touching or even possibly not even touching the sidewall of the wellbore. The result is the packer does not form a seal with the sidewall of the wellbore. The centralizing mechanism and kit introduced herein may reduce the eccentric position of the downhole tool when the tool is set for sampling or otherwise. The downhole tool is fitted with a rigid member (e.g., an extendable centralizing plate) so that when setting pistons are extended, the tool is better centered in the wellbore and packers are more evenly compressed against the sidewall of the wellbore. A possible result is that the packers can sustain higher drawdown pressure with less leakage. The setting pistons may be telescopic and can be independently extended from the downhole tool on a side of the module opposite the probe or other feature.

The downhole tool introduced herein can be employed with a Quicksilver probe, other focused sampling probes, other sampling probes, and/or other downhole tools to operate with an improved seal between packers and the surface of a wellbore. The downhole tool includes a rigid member or plate affixed to ends of extendable pistons to position the tool so that packers may be aligned with the surface of the wellbore during setting to possibly improve the sealing functions of the packers.

Figure 14:
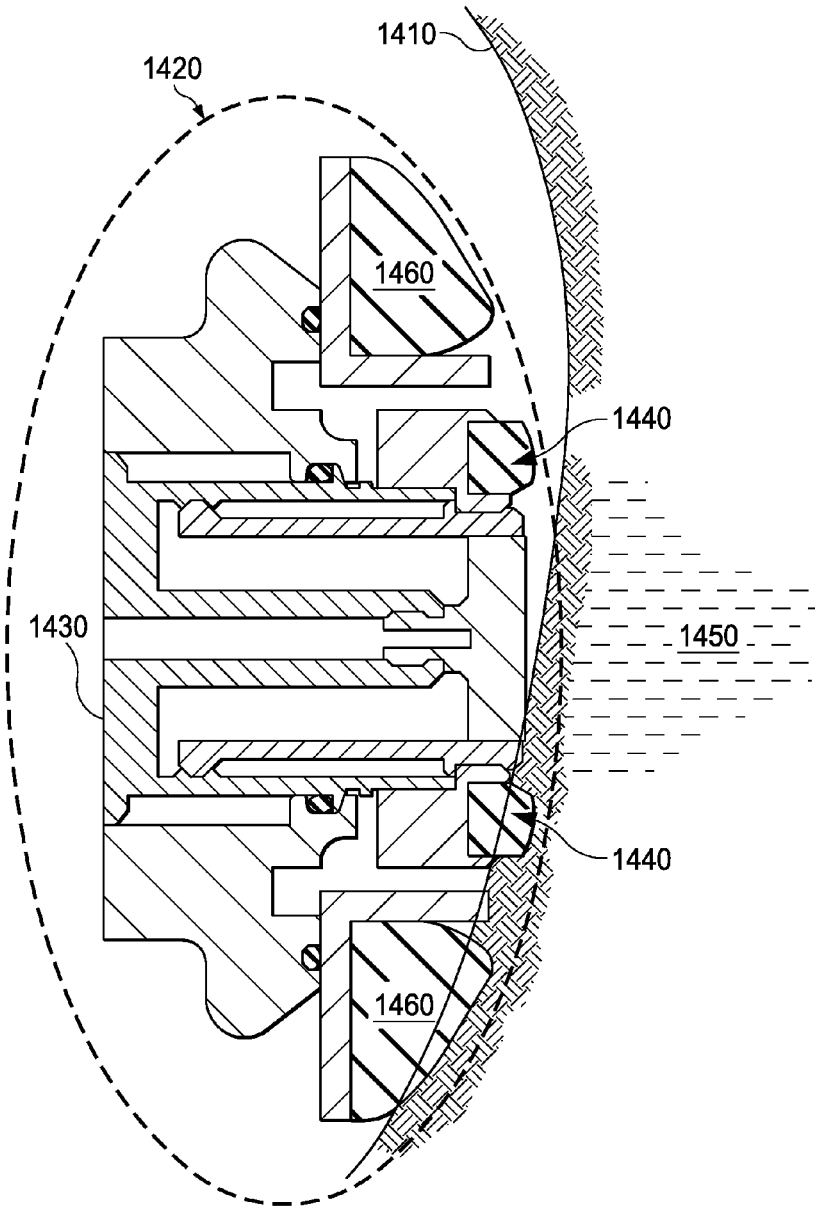

Referring to FIG. 14, illustrated is a schematic view of an apparatus or portions thereof (e.g., retrievable packer module) according to one or more aspects of the present disclosure. The retrievable packer module uses a focused sampling technology wherein two compressible packers (an inner compressible packer 1440 and an outer compressible packer 1460) are employed to form seals between a probe (or feature) 1420 of the module and a sidewall 1410 of the wellbore that lines the surrounding formation 1450. Accordingly, the surrounding formation 1450 may be fluidly isolated from the wellbore. The general shape of the inner and outer compressible packers 1440, 1460, which are often made of a hard rubber or rubber-like material, is toroidal.

The modular retrievable packer module may be equipped with two flowlines in addition to the inner and outer compressible packers 1440, 1460. The inner compressible packer 1440 is used to collect a clean sample and the outer compressible packer 1460 is used to pump mud filtrate away from the inner packer. The inner compressible packer 1440 of the probe 1420 is extended to contact the sidewall 1410 of the wellbore by a telescopic probe piston 1430. As illustrated herein, because the probe 1420 of the downhole tool is not well centered in relation to the sidewall 1410 of the formation, the lower portions of the inner and outer compressible packers 1440, 1460 contact the sidewall 1410 of the wellbore. As a result, an incomplete seal is formed by the inner and outer compressible packers 1440, 1460 with the sidewall 1410 of the wellbore.

Figure 15:
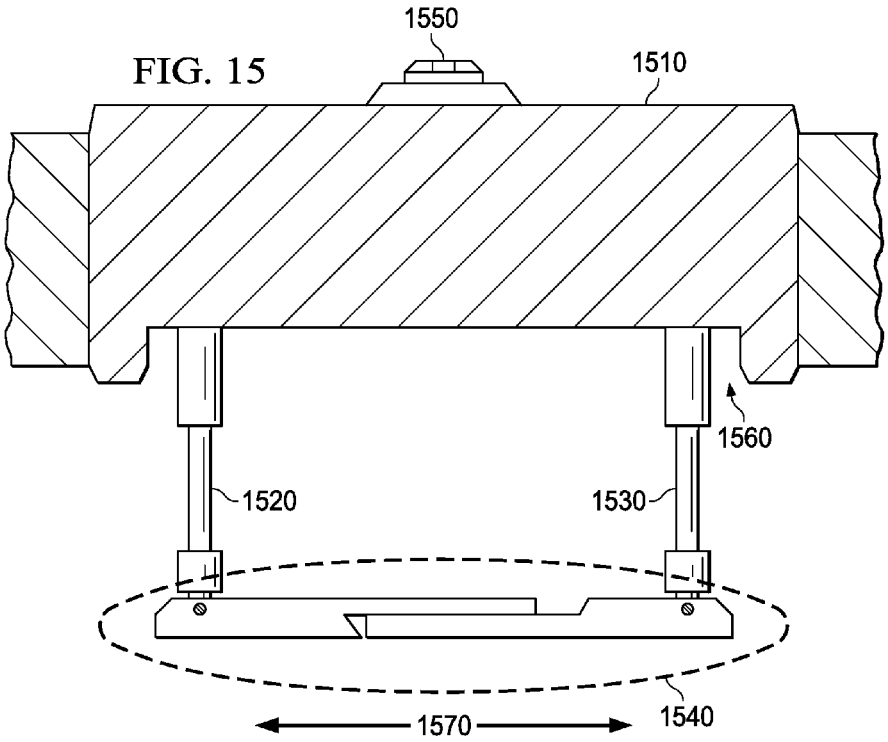

Referring to FIG. 15, illustrated is a schematic view of an apparatus or portions thereof according to one or more aspects of the present disclosure. In the illustrated embodiment, a downhole tool module 1510 is formed with a rigid member 1540 constructed as an extendable centralizing plate attached to first and second telescopic pistons 1520, 1530. The rigid member 1540 is attached to the downhole tool module 1510 at the ends of the first and second telescopic pistons 1520, 1530 that are positioned close to a feature (e.g., a probe 1550). The first and second telescopic pistons 1520, 1530 are independently extendable. The rigid member 1540 that contacts and slides along the sidewall of the wellbore enables the downhole tool module 1510 to be substantially centralized in the wellbore. The axis of the wellbore is indicated by the arrows 1570. The downhole tool module 1510 is equipped with the probe 1550 that may sample a surrounding formation, measure a fluid pressure, etc. The downhole tool module 1510 is formed with a recess 1560 so that the rigid member 1540 may be withdrawn into a protective structure when the downhole tool module 1510 is moved along the axis of the wellbore. The extendable rigid member 1540 can be powered locally or by a power source at the ground surface.

Figure 16A:
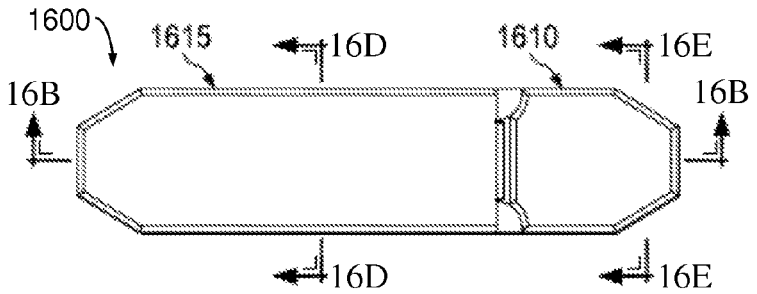

Referring to FIGS. 16A to 16E, illustrated are views of an apparatus or portions thereof according to one or more aspects of the present disclosure. More specifically, FIGS. 16A to 16E illustrate a rigid member formed as an extendable centralizing plate 1600. FIG. 16A illustrates a plan view of the extendable centralizing plate 1600 formed with a first portion 1610 and a second portion 1615. The first portion 1610 and the second portion 1615 slide with respect to each other along a tenon 1612 formed in the first portion 1610 and a corresponding mortise 1617 formed in the second portion 1615, thereby enabling relative translation between the first portion 1610 and the second portion 1615 to provide a variable length L of the extendable centralizing plate 1600. The extendable centralizing plate 1600 facilitates the use of independently extendable setting pistons, for example in cases where the surface of the sidewall of the wellbore is non-uniform.

The width W of the extendable centralizing plate 1600 enables contact with the sidewall of the wellbore at a sharp angle resulting in a better sliding force for the plate. This characteristic is useful in a soft formation and/or a wellbore lined with mudcake. The length L of the extendable centralizing plate 1600 should be selected to accommodate non-uniformity of the surface of the sidewall of the wellbore. The length L of the extendable centralizing plate 1600 is, for instance, 14 inches (35.6 cm). As a further enhancement, the extendable centralizing plate 1600 can be equipped with a roller to reduce further its friction with certain sidewall materials.

Figure 16B:
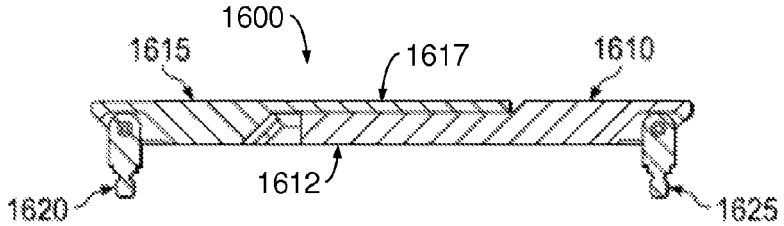
Figure 16C:
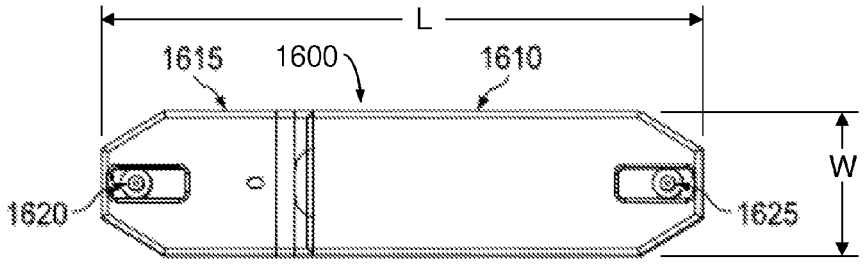
Figure 16D:
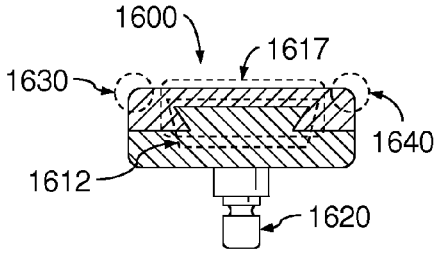
Figure 16E:
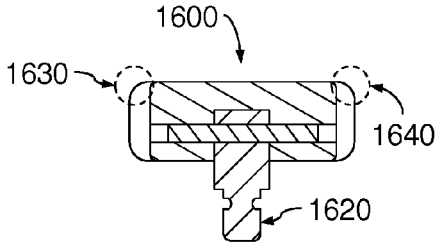

FIG. 16B illustrates a lateral sectional view of the extendable centralizing plate 1600 shown in FIG. 16A and depicting hinged pins 1620, 1625 to allow the extendable centralizing plate 1600 to be hinged to respective ends of the first and second telescopic setting pistons. FIG. 16C illustrates a bottom view of the extendable centralizing plate 1600, and FIGS. 16D and 16E illustrate enlarged cross sectional views of the extendable centralizing plate 1600. As illustrated in FIGS. 16D and 16E, a rounded wellbore interface 1630, 1640 is formed along the outer edges of the extendable centralizing plate to enable the extendable centralizing plate to slide along the sidewall of the wellbore. A radius of the rounded wellbore interface 1630, 1640 may be about one eighth of an inch, although other radii are also within the scope of the present disclosure. The radius of the rounded wellbore interface 1660 should be restrained to avoid too large a contact area between the extendable centralizing plate and the sidewall of the wellbore, which produces large friction therebetween.

Figure 17:
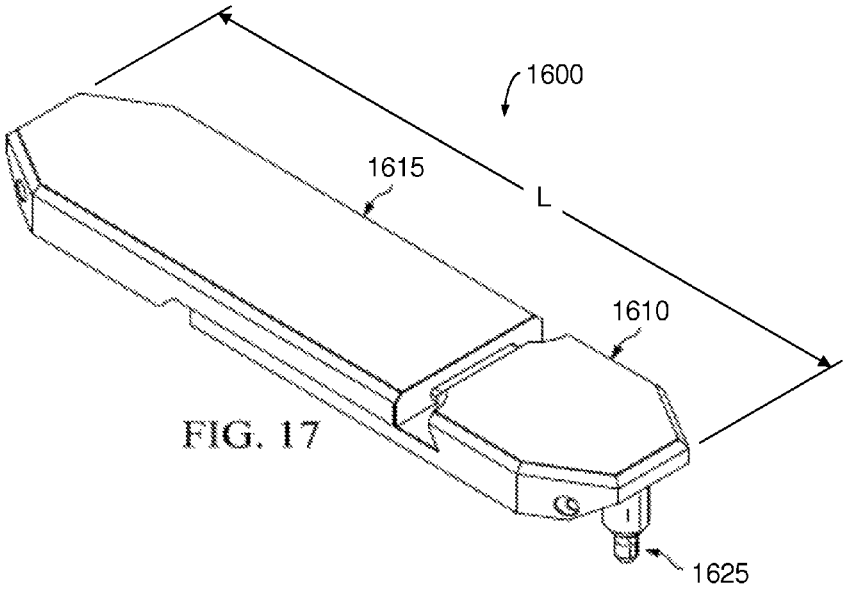

Referring to FIG. 17, illustrated is a schematic view of the extendable centralizing plate 1600 shown in FIGS. 16A-16E. The isometric drawing illustrates the first portion 1610 and the second portion 1615 partially extended, and the hinged pin 1625. The illustrated embodiment shows the variable length L of the extendable centralizing plate 1600, demonstrating the flexibility of its use in many applications.

Figure 18:
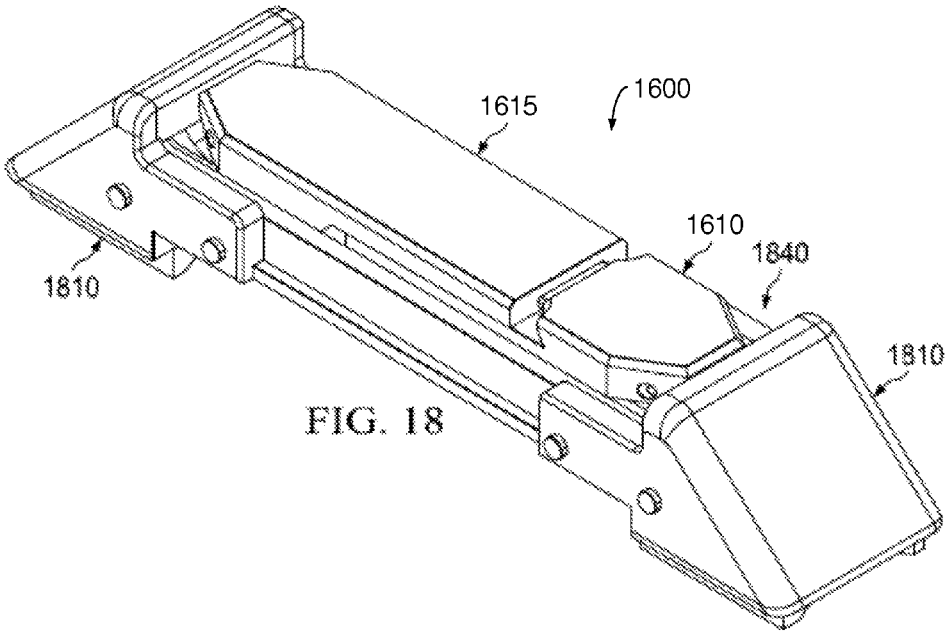

Referring to FIG. 18, illustrated is a schematic view of a protective structure 1810 for the extendable centralizing plate 1600 shown in FIGS. 16A-16E and 17. The extendable centralizing plate 1600 formed with the first portion 1610 and the second portion 1615 is withdrawn into the protective structure 1810. The first portion 1610 and the second portion 1615 of the extendable centralizing plate 1600 are substantially retracted when the first and second setting pistons are not extended so that the extendable centralizing plate 1600 is positioned within a recess 1840 of the protective structure 1810. Thus, the protective structure 1810 substantially surrounds at least ends of the extendable centralizing plate 1600 when the first and second setting pistons are retracted.

Figure 19A:
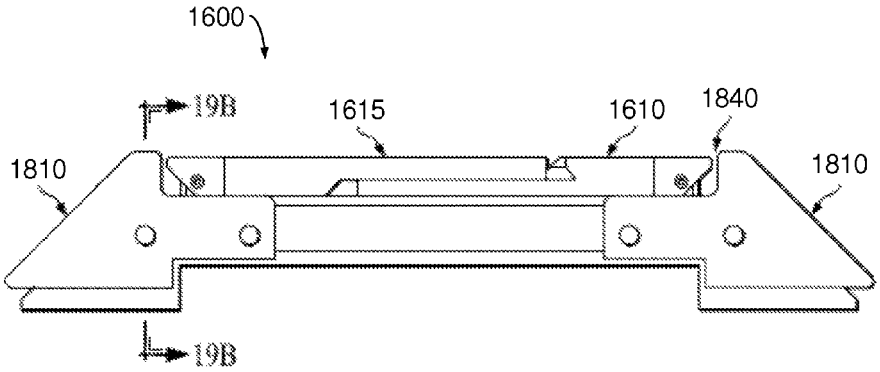
Figure 19B:
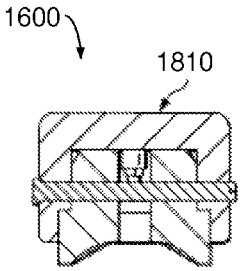

FIG. 19A is a side view of the apparatus shown in FIG. 18, and FIG. 19B illustrates a cross sectional view of the apparatus shown in FIG. 19A. The first portion 1610 and the second portion 1615 of the extendable centralizing plate 1600 are substantially retracted when the first and second setting pistons are not extended so that the extendable centralizing plate 1600 is positioned within the recess 1840 of the protective structure 1810. Thus, the protective structure 1810 substantially surrounds at least ends of the extendable centralizing plate 1600 when the first and second setting pistons are retracted.

Apparatuses illustrated in FIGS. 15 to 19 can be supplied as a kit to retrofit a downhole tool. The kit can include the elements of the rigid member, particularly if there is sufficient external structure of the downhole tool to mechanically protect the rigid member when the setting pistons are retracted and the downhole tool is moved along the wellbore. The protective structure may be included in the kit, particularly if there is insufficient external structure of the downhole tool for its mechanical protection when the setting pistons are retracted. The protective structure substantially surrounds at least ends of the rigid member when the first and second setting pistons are retracted.

Figure 20:
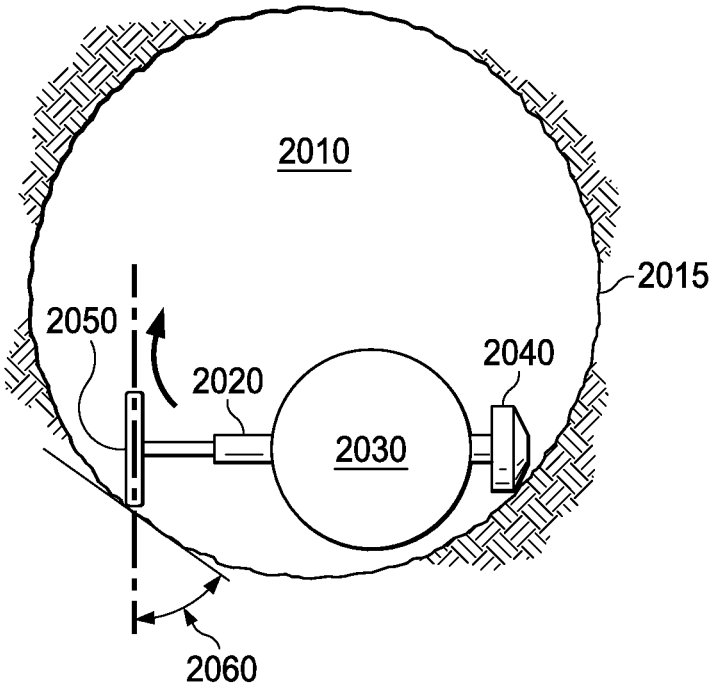
Figure 21:
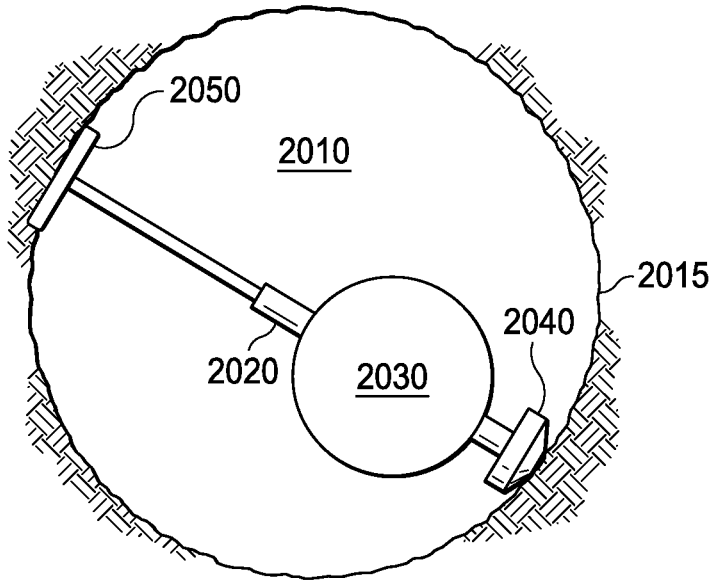

Referring to FIGS. 20 and 21, illustrated are schematic views of an apparatus or portions thereof according to one or more aspects of the present disclosure. A module 2030 of a downhole tool is illustrated within a wellbore 2010. A feature (e.g., a probe 2040) of the module 2030 is extended by a telescopic piston from a side of the module 2030 to physically interface a sidewall 2015 of the wellbore 2010. A rigid member (e.g., an extendable centralizing plate 2050) is positioned against the sidewall 2015 of the wellbore 2010 by partially extended telescopic setting pistons (one of which is designated 2020). The extendable centralizing plate 2050 forms a relatively sharp angle 2060 with the sidewall 2015 of the wellbore 2010. Since the module 2030 is positioned in an eccentric position in the wellbore 2010, a packer positioned at the end of the probe 2040 would not form a complete seal with the sidewall 2015 of the wellbore 2010.

Referring to FIG. 21, the telescopic setting pistons 2020 have now been fully extended. The fully extended telescopic setting pistons 2020 cause the extendable centralizing plate 2050 to contact and slide along the sidewall 2015 of the wellbore 2010 opposite the probe 2040 or other feature that physically interfaces with the sidewall 2015 so that the module 2030 becomes substantially centralized within the aperture of the wellbore 2010. With continuing reference to FIG. 20, the relatively sharp angle 2060 facilitates sliding of the extendable centralizing plate 2050 along the sidewall 2015. As a result, the packer positioned at the end of the probe 2040 forms a complete seal with the sidewall 2015 of the wellbore 2010 after the telescopic setting pistons 2020 are extended (e.g., fully extended).

In operation, a downhole tool including (e.g., a Quicksilver probe module) is lowered into a wellbore. Hydrostatic pressure is automatically applied to the backside of a compensating piston, which increases pressure in the downhole tool hydraulic system. A flow line is opened to the wellbore from equalization valve(s) in the probe or packer module. The tool is now set in place for testing, and setting and probe pistons are extended. Fluid flows into the flow line and a pretest process is initiated. A decision to proceed is made dependent on sample or other pretest data. If sampling is to proceed, pumps are operated until the sampling fluid is clean enough to take a proper sample. Sample chamber valves are closed and the setting and probe pistons are retracted. It can generally be determined when the sampling chamber is full by monitoring flow-line pressures. Tests or other functional operations may be repeated at the same or different locations.

Figure 22:
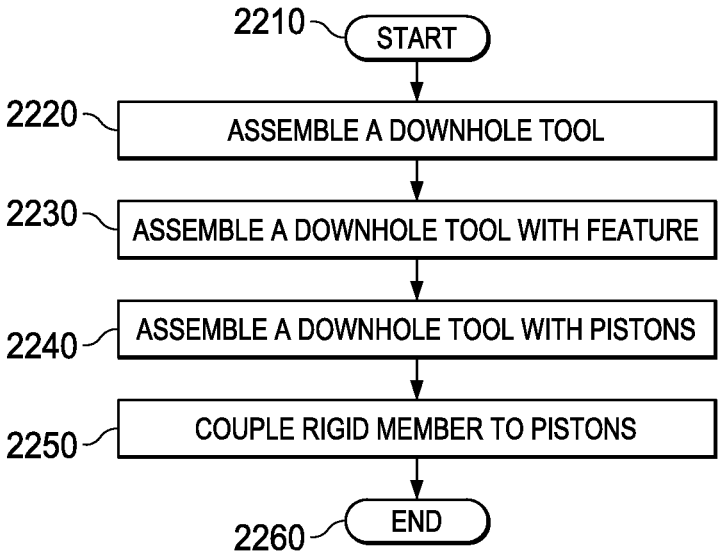
FIGS. 22 and 23 are flow charts of embodiments of methods according to one or more aspects of the present disclosure.

Referring to FIG. 22, illustrated is a flow chart of a method according to one or more aspects of the present disclosure. The method begins in a module 2210. In a module 2220, a downhole tool for conveyance within a wellbore extending into a subterranean formation is assembled. The downhole tool may include a sidewall coring tool, a formation pressure testing tool, a formation fluid sampling tool, a NMR tool, a seismic tool and a formation perforating tool. In a module 2230, the downhole tool is assembled with a feature (e.g., a probe) to physically interface a sidewall of the wellbore. The downhole tool may include a telescopic piston to extend the feature from the downhole tool. In a module 2240, the downhole tool is assembled with first and second setting pistons (e.g., first and second telescopic setting pistons) each extendable (e.g., independently extendable) from the downhole tool opposite the feature.

In a module 2250, a rigid member (e.g., an extendable centralizing plate with a rounded wellbore interface) is coupled (e.g., hinged) to respective ends of the first and second setting pistons, wherein a length of the rigid member is variable. The rigid member may include first and second portions, wherein the first portion is coupled to the first setting piston but not the second setting piston and the second portion is coupled to the second setting piston but not the first setting piston. The first and the second portions translate relative to one another. The rigid member may include a protective structure about an end of the rigid member. The downhole tool may include a recess to receive the rigid member when the rigid member and the first and second setting pistons are not extended. The method ends at module 2260.

Figure 23:
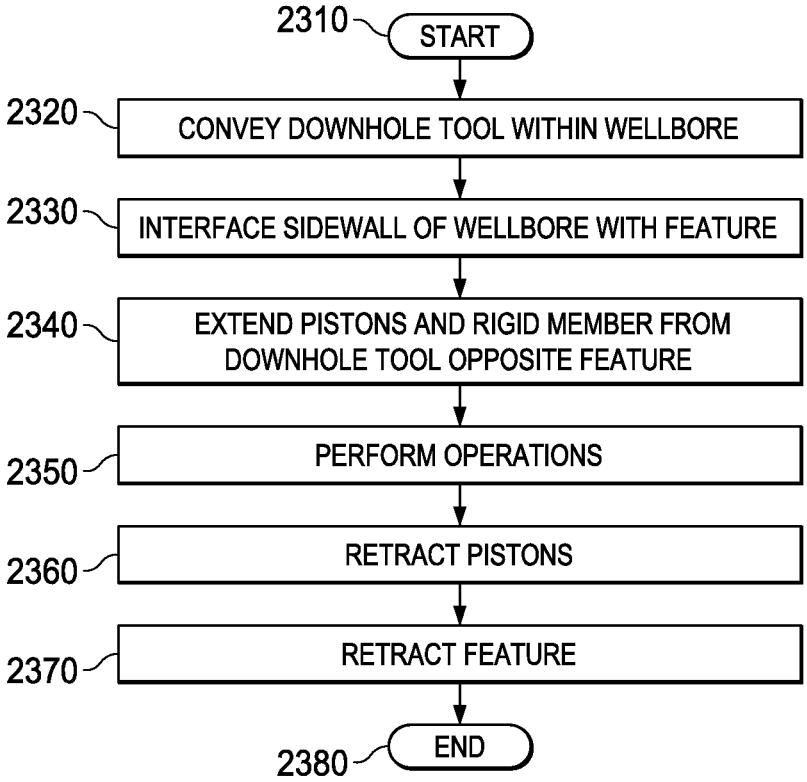

Referring to FIG. 23, illustrated is a flow chart of a method according to one or more aspects of the present disclosure. The method begins in a module 2310. In a module 2320, a downhole tool is conveyed within a wellbore extending into a subterranean formation. In a module 2330, a feature (e.g., a probe) of the downhole tool physically interfaces a sidewall of the wellbore. As further examples, the feature may include a bit to isolate the formation from the wellbore, or drill (or core) into the formation, and the physical interface includes extending the bit from the downhole tool, or the bit into the formation. In a module 2340, the first and second setting pistons and the rigid member extend (e.g., independently extendable) from the downhole tool and interface the sidewall of the wellbore opposite the feature. The rigid member spans the first and second pistons and a length thereof is variable. The rigid member in cooperation with the first and second setting pistons locate the downhole tool substantially in the center of the wellbore.

Thereafter, the downhole tool performs operations on the formation in a module 2350. The operations may include, without limitation, removing material from the formation using the feature, adding material into the formation using the feature, transferring energy (e.g., acoustic, nuclear, electrical, mechanical, hydraulic) between the formation and the downhole tool. In accordance therewith, the downhole tool may include a sidewall coring tool, a formation pressure testing tool, a formation fluid sampling tool, a NMR tool, a seismic tool and a formation perforating tool. When the operations are complete or otherwise, the first and second pistons and rigid member are retracted from the sidewall of the wellbore in a module 2360. The rigid member may be retracted into a recess in the downhole tool. In a module 2370, the feature is also retracted from the sidewall of the wellbore. As a result, the downhole tool may be conveyed to another location in the wellbore. The method ends at module 2380.

Thus, a downhole tool for conveyance in a wellbore extending into a subterranean formation and method of operating and assembling the same has been introduced herein. The downhole tool may include a feature (e.g., a probe) to physically interface a sidewall of the wellbore, first and second setting pistons (e.g., telescopic pistons) each extendable (e.g., independently extendable) from the downhole tool opposite the feature, and a rigid member spanning and extendable with the first and second setting pistons, wherein a length of the rigid member is variable.

The feature may physically interface the sidewall of the wellbore or the formation via direct physical contact. In accordance therewith, the feature isolates a formation from the wellbore or remove material from the formation. The feature is also transfers energy (e.g., acoustic energy, nuclear energy, electrical energy, mechanical energy, hydraulic energy) between the formation and the downhole tool. The downhole tool may include a telescopic piston to extend the feature from the downhole tool.

The rigid member may include a first portion coupled to the first setting piston but not the second setting piston, and a second portion coupled to the second setting piston but not the first setting piston, wherein the first and the second portions translate relative to one another. The rigid member may also include a rounded wellbore interface. The rigid member may be hinged to respective ends of the first and second setting pistons. The downhole tool may include a recess to receive the rigid member when the rigid member and the first and second setting pistons are not extended. The downhole tool may also include a protective structure about an end of the rigid member.

The downhole tool may include other tools depending on the application. As non-limiting examples, the downhole tool may include a sidewall coring tool, a formation pressure testing tool, a formation fluid sampling tool, a nuclear magnetic resonance tool, a seismic tool and a formation perforating tool.

A kit employable with a downhole tool for conveyance in a wellbore extending into a subterranean formation and having a feature to physically interface a sidewall of the wellbore is introduced herein. The kit includes an extendable rigid member, having a variable length, to be coupled to and span first and second setting pistons of the downhole tool opposite the feature. The rigid member may include a first portion to be coupled to the first setting piston but not the second setting piston, and a second portion to be coupled to the second setting piston but not the first setting piston, wherein the first and the second portions translate relative to one another. The rigid member may include a rounded wellbore interface. The kit may also include a hinged pin to couple the rigid member to respective ends of the first and second setting pistons. The kit may also include a protective structure to substantially surround at least ends of the rigid member when the first and second setting pistons are retracted. In other words, the rigid member is positioned within a recess of the protective structure.

In view of all of the above and the figures, those skilled in the art should readily recognize that the present disclosure introduces an apparatus comprising: a downhole tool conveyable in a wellbore extending into a subterranean formation, the downhole tool comprising: a feature to physically interface the formation or a sidewall of the wellbore via direct physical contact; first and second setting pistons each extendable from the downhole tool opposite the feature; and a rigid member spanning and extendable with the first and second setting pistons, wherein a length of the rigid member is variable. The rigid member may comprise: a first portion coupled to the first setting piston but not the second setting piston; and a second portion coupled to the second setting piston but not the first setting piston, wherein the first and the second portions translate relative to one another. The first and second setting pistons may be telescopic. The first and second setting pistons may be independently extendable from the downhole tool. The rigid member may be hinged to respective ends of the first and second setting pistons. The feature may be or comprise a probe that is extendable from the downhole tool. The downhole tool may comprise a recess to receive the rigid member when the rigid member and the first and second setting pistons are not extended. The downhole tool may further comprise a protective structure about an end of the rigid member. The feature may be to isolate the formation from the wellbore. The feature may be to remove material from the formation or to add material into the formation. The feature may be to transfer energy between the formation and the downhole tool, wherein the transferred energy comprises at least one of acoustic energy, nuclear energy, electrical energy, mechanical energy, and hydraulic energy. The downhole tool may comprise at least one of a sidewall coring tool, a formation pressure testing tool, a formation fluid sampling tool, a nuclear magnetic resonance (NMR) tool, a seismic tool, and a formation perforating tool.

The present disclosure also introduces a method comprising: conveying a downhole tool within a wellbore extending into a subterranean formation, wherein the downhole tool comprises: a feature to physically interface the formation or a sidewall of the wellbore via direct physical contact; first and second setting pistons each extendable from the downhole tool opposite the feature; and a rigid member spanning and extendable with the first and second setting pistons, wherein a length of the rigid member is variable; physically interfacing the feature with the sidewall of the wellbore; and extending the first and second setting pistons and the rigid member from the downhole tool into contact with the sidewall of the wellbore opposite the feature interface with the sidewall of the wellbore. Extending the first and second setting pistons and the rigid member may comprise independently extending the first and second setting pistons. The feature may comprise a bit, and the method may further comprise extending the bit from the downhole tool. The method may further comprise removing material from the formation, or adding material into the formation, using the feature. The method may further comprise transferring energy between the formation and the downhole tool, wherein the transferred energy may comprise at least one of acoustic energy, nuclear energy, electrical energy, mechanical energy, and hydraulic energy. The downhole tool may further comprise a recess to receive the rigid member, and the method may further comprise retracting the first and second setting pistons sufficient for the recess to receive the rigid member.

The present disclosure also introduces a kit employable with a downhole tool conveyable in a wellbore extending into a subterranean formation and having a feature to physically interface the formation or a sidewall of the wellbore via direct physical contact. The kit may comprise an extendable rigid member, having a variable length, to be coupled to and span first and second setting pistons of the downhole tool opposite the feature. The rigid member may comprise a first portion to be coupled to the first setting piston but not the second setting piston, and a second portion to be coupled to the second setting piston but not the first setting piston, wherein the first and the second portions translate relative to one another. The kit may further comprise: a hinged pin to couple the rigid member to respective ends of the first and second setting pistons; and a protective structure to substantially surround at least ends of the rigid member when the first and second setting pistons are retracted.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool conveyable in a wellbore extending into a subterranean formation, the downhole tool comprising:

a feature to physically interface the formation or a sidewall of the wellbore via direct physical contact;

first and second setting pistons each extendable from the downhole tool along paths substantially parallel to one another in a first direction and opposite the feature; and a rigid member spanning and extendable with the first and second setting pistons, wherein a length of the rigid member is variable in a second direction and wherein the rigid member comprises:

a first portion coupled to the first setting piston but not the second setting piston; and a second portion coupled to the second setting piston but not the first setting piston, wherein the first and second portions translate relative to one another and the first portion and the second portion are configured to contact the sidewall of the wellbore.

2. The apparatus of claim 1 wherein the first and second setting pistons are telescopic.

3. The apparatus of claim 1 wherein the first and second setting pistons are independently extendable from the downhole tool.

4. The apparatus of claim 1 wherein the rigid member is hinged to respective ends of the first and second setting pistons.

5. The apparatus of claim 1 wherein the feature is or comprises a probe that is extendable from the downhole tool.

6. The apparatus of claim 1 wherein the downhole tool comprises a recess to receive the rigid member when the rigid member and the first and second setting pistons are not extended.

7. The apparatus of claim 1 wherein the downhole tool further comprises a protective structure about an end of the rigid member.

8. The apparatus of claim 1 wherein the feature is to isolate the formation from the wellbore.

9. The apparatus of claim 1 wherein the feature is to remove the material from the formation or to add material into the formation.

10. The apparatus of claim 1 wherein the feature is to transfer energy between the formation and the downhole tool, wherein the transferred energy comprises at least one of acoustic energy, nuclear energy, electrical energy, mechanical energy, and hydraulic energy.

11. The apparatus of claim 1 wherein the downhole tool comprises at least one of a sidewall coring tool, a formation pressure testing tool, a formation fluid sampling tool, a nuclear magnetic resonance (NMR) tool, a seismic tool, and a formation perforating tool.

12. The apparatus of claim 1 wherein the first direction is substantially perpendicular to the second direction.

13. A method comprising:

providing a downhole tool conveyable within a wellbore extending into a subterranean formation, wherein the downhole tool comprises:

a feature to physically interface the formation or a sidewall of the wellbore via direct physical contact; and first and second setting pistons each extendable from the downhole tool along paths substantially parallel to one another and extending in a first direction substantially opposite the feature;

attaching a rigid member to the first and second setting pistons such that the rigid member spans the first and second setting pistons, wherein a length of the rigid member is variable in a second direction that is substantially different from the first direction and wherein the rigid member comprises:

a first portion coupled to the first setting piston but not the second setting piston; and a second portion coupled to the second setting piston but not the first setting piston, wherein the first and the second portions translate relative to one another;

conveying the downhole tool with the attached rigid member within the wellbore;

physically interfacing the feature with the sidewall of the wellbore; and extending the first and second setting pistons and the attached rigid member in the first direction, away from the downhole tool and into contact with the sidewall of the wellbore opposite the feature interface with the sidewall of the wellbore, wherein the first portion and the second portion of the rigid member each contact the sidewall of the wellbore.

14. The method of claim 13 wherein extending the first and second setting pistons and the attached rigid member comprises independently extending the first and second setting pistons in the first direction.

15. The method of claim 13 wherein the feature comprises a bit, and wherein the method further comprises extending the bit from the downhole tool in a third direction substantially opposite the first direction.

16. The method of claim 13 further comprising at least one of removing material from the formation using the feature, adding material into the formation using the feature, and transferring energy between the formation and the downhole tool using the feature, wherein the transferred energy comprises at least one of acoustic energy, nuclear energy, electrical energy, mechanical energy, and hydraulic energy.

17. The method of claim 13 wherein the first and second directions are substantially perpendicular.

18. The method of claim 13 wherein the downhole tool further comprises a recess to receive the rigid member, and wherein the method further comprises retracting the first and second setting pistons sufficient for the recess to receive the rigid member, wherein the retracting is in a third direction substantially opposite the first direction.

19. The method of claim 13 wherein the first direction is substantially perpendicular to the second direction.

20. A kit employable with a downhole tool conveyable in a wellbore extending into a subterranean formation and having a feature to physically interface the formation or a sidewall of the wellbore via direct physical contact, the kit comprising:

an extendable rigid member, having a variable length in a first direction, to be coupled to and span first and second setting pistons of the downhole tool opposite the feature such that extension of the first and second setting pistons along paths substantially parallel to one another and substantially perpendicular to the first direction translates the extendable rigid member away from the downhole tool in a second direction, wherein the rigid member comprises a first portion to be coupled to the first setting piston but not the second setting piston, and a second portion to be coupled to the second setting piston but not the first setting piston, wherein the first and second portions translate relative to one another in the first direction and the first portion and the second portion are configured to contact the sidewall of the wellbore.

21. The kit of claim 20 wherein the kit further comprises:

a hinged pin to couple the rigid member to respective ends of the first and second setting pistons; and a protective structure to substantially surround at least ends of the rigid member when the first and second setting pistons are retracted.

* * * * *